US009315031B2

(12) United States Patent
Takeuchi et al.

(10) Patent No.: US 9,315,031 B2
(45) Date of Patent: Apr. 19, 2016

(54) INK JET RECORDING APPARATUS

(71) Applicant: SEIKO EPSON CORPORATION, Tokyo (JP)

(72) Inventors: Hiroshi Takeuchi, Matsumoto (JP); Hiroyuki Yoda, Shiojiri (JP); Kenji Oshima, Minowa-machi (JP); Yoshisada Aoki, Azumino (JP); Satoshi Shimizu, Shiojiri (JP); Kazutoshi Sakamoto, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/375,424

(22) PCT Filed: Jan. 25, 2013

(86) PCT No.: PCT/JP2013/000402

§ 371 (c)(1),
(2) Date: Jul. 29, 2014

(87) PCT Pub. No.: WO2013/114841

PCT Pub. Date: Aug. 8, 2013

(65) Prior Publication Data

US 2015/0035914 A1 Feb. 5, 2015

(30) Foreign Application Priority Data

Jan. 30, 2012 (JP) ..... 2012-016261
Feb. 27, 2012 (JP) ..... 2012-040766

(51) Int. Cl.
*B41J 2/175* (2006.01)
*B41J 25/34* (2006.01)

(Continued)

(52) U.S. Cl.
CPC ..... *B41J 2/175* (2013.01); *B41J 2/17509* (2013.01); *B41J 2/17523* (2013.01); *B41J 19/20* (2013.01); *B41J 25/34* (2013.01); *B41J 29/023* (2013.01); *B41J 29/13* (2013.01)

(58) Field of Classification Search
CPC ..... B41J 2/175; B41J 25/34; B41J 29/13
See application file for complete search history.

(56) References Cited

U.S. PATENT DOCUMENTS 7,631,965 B2 * 12/2009 Samoto ..... B41J 29/13 347/108
2009/0237469 A1 9/2009 Miyajima et al.

(Continued)

FOREIGN PATENT DOCUMENTS

CN 2825289 Y 10/2006
JP 2003-298790 10/2003

(Continued)

OTHER PUBLICATIONS

PCT/JP2013/000402, International Search Report dated May 14, 2013 (6 pages).

(Continued)

*Primary Examiner* — Sarah Al Hashimi
(74) *Attorney, Agent, or Firm* — Workman Nydegger

(57) ABSTRACT

Provided is a recording apparatus allowing for a reduction in size of an ink jet recording apparatus.
An ink jet recording apparatus includes a head unit that has a recording head which ejects ink and a relay adapter which relays an ink accommodating portion where ink is accommodated with the recording head, and is movable in a scanning direction of the recording head, and an ink tube that is connected to the relay adapter, guides ink which is sent from the ink accommodating portion to the relay adapter, and has flexibility, in which a height difference is formed in an upper portion of an adapter accommodating portion, where the relay adapter is accommodated, of the head unit, and the ink tube extends outside the head unit by using a space between a high position and a low position of the adapter accommodating portion.

17 Claims, 26 Drawing Sheets

(51) Int. Cl.

| | |
|---|---|
| ***B41J 29/13*** | (2006.01) |
| ***B41J 19/20*** | (2006.01) |
| ***B41J 29/02*** | (2006.01) |

(56) References Cited

U.S. PATENT DOCUMENTS

| | | | | |
|---|---|---|---|---|
| 2010/0110120 | A1* | 5/2010 | Hattori et al. | 347/9 |
| 2012/0038719 | A1 | 2/2012 | Shimizu et al. | |
| 2013/0057620 | A1 | 3/2013 | Kobayashi | |
| 2013/0057621 | A1 | 3/2013 | Kobayashi | |

FOREIGN PATENT DOCUMENTS

| | | |
|---|---|---|
| JP | 2009-226686 | 10/2009 |
| JP | 2010-131893 | 6/2010 |
| JP | 2011-037278 | 2/2011 |
| JP | 2011-230416 | 11/2011 |
| JP | 2012-061620 | 3/2012 |
| JP | 2012-076224 | 4/2012 |
| WO | 2009-119084 | 10/2009 |
| WO | 2011-129123 | 10/2011 |

OTHER PUBLICATIONS

Ink continuation feed system How to make the ink cost of a printer cheap certainly; <http:inkmiyax.blog81.fc2.com/blog-category-10.htm>; accessed May 28, 2014; (22 pages).

* cited by examiner

INK JET RECORDING APPARATUS

TECHNICAL FIELD

The present invention relates to a recording apparatus that includes a recording head which ejects ink to a recording medium to perform recording.

The type of the recording apparatus according to the present invention includes ink jet printers, line printers, copying machines, and facsimiles.

BACKGROUND ART

In the related art, an ink jet recording apparatus that performs recording by ejecting ink to a recording medium as illustrated in PTL 1 includes a head unit which is supported to be capable of reciprocating in a predetermined direction of movement with a recording head mounted on the head unit. Between the head unit and an ink accommodating portion that accommodates ink, an ink tube is disposed to be capable of supplying ink to the head unit from the ink accommodating portion.

CITATION LIST

Patent Literature

PTL 1: Japanese Unexamined Patent Application

SUMMARY OF INVENTION

Technical Problem

In the ink jet recording apparatus, one end side of the ink tube is connected to a side surface of the head unit and the other end side is connected to the ink accommodating portion. Accordingly, in the recording apparatus, a space has to be ensured to allow the ink tube to extend from the head unit, which causes the recording apparatus to become larger in size.

The present invention has been made in view of this disadvantage, and an object thereof is to provide a recording apparatus allowing for a reduction in size of an ink jet recording apparatus.

Solution to Problem

In order to achieve the above-described object, according to a first aspect of the present invention, there is provided an ink jet recording apparatus including a head unit that has a recording head which ejects ink and a relay adapter which relays an ink accommodating portion where ink is accommodated with the recording head, and is movable in a scanning direction of the recording head, and an ink tube that is connected to the relay adapter, guides ink which is sent from the ink accommodating portion to the relay adapter, and has flexibility, in which a height difference is formed in an upper portion of an adapter accommodating portion, where the relay adapter is accommodated, of the head unit, and the ink tube extends outside the head unit by using a space between a high position and a low position of the adapter accommodating portion.

According to this aspect, the space that is generated by the height difference which is formed in the upper portion of the adapter accommodating portion of the head unit is used to connect the relay adapter which is accommodated in the head unit to the ink tube and allow the ink tube to extend from the relay adapter, and thus the ink jet recording apparatus can be compact in size.

According to a second aspect of the present invention, there is provided the ink jet recording apparatus further including a housing that has a cover portion which covers at least a part of an area of movement of the head unit from above, in which a first space and a second space, which is a space wider than the first space, are formed between the cover portion and the adapter accommodating portion by the height difference formed in the upper portion of the adapter accommodating portion, and an extending portion, where the ink tube extends from the head unit, is arranged in the second space.

According to a third aspect of the present invention, there is provided the ink jet recording apparatus further including a plurality of the ink tubes, in which the plurality of ink tubes are arranged in an up-and-down direction to extend from the head unit.

According to a fourth aspect of the present invention, there is provided the ink jet recording apparatus further including a plurality of the ink tubes, in which the plurality of ink tubes are arranged in a horizontal direction to extend from the head unit.

According to a fifth aspect of the present invention, there is provided the ink jet recording apparatus further including a plurality of the ink tubes, in which the plurality of ink tubes are arranged in a transverse direction on an upper surface of the housing to be fixed to the upper surface of the housing.

According to a sixth aspect of the present invention, there is provided the ink jet recording apparatus in which the housing has an opening portion that exposes an upper portion of at least a part of an area of movement of the head unit, and a concave portion, which extends laterally from the opening portion, on an upper surface when a side where a discharge port, where a recording medium on which recording is performed is discharged, is disposed is a forward side of the apparatus, and the ink tube extends laterally from the housing through the concave portion.

According to a seventh aspect of the present invention, there is provided the ink jet recording apparatus further including a plurality of the ink tubes, in which the plurality of ink tubes are arranged in a horizontal direction in the concave portion.

According to an eighth aspect of the present invention, there is provided the ink jet recording apparatus in which a plurality of the ink tubes that are arranged in a horizontal direction in the concave portion are fixed into the concave portion.

According to a ninth aspect of the present invention, there is provided the ink jet recording apparatus further including a plurality of the ink tubes, in which an array direction of the plurality of ink tubes is converted from a horizontal direction to an up-and-down direction or from the up-and-down direction to the horizontal direction by an array conversion unit that converts the array direction of the plurality of ink tubes.

According to a tenth aspect of the present invention, there is provided the ink jet recording apparatus in which the ink accommodating portion is provided outside the housing.

In order to achieve the above-described object, according to an eleventh aspect of the present invention, there is provided an ink jet recording apparatus including a printer unit, and a scanner unit that is mounted in an openable/closable manner on the printer unit, in which the printer unit has a housing, an ink accommodating portion where ink is accommodated, and a head unit that is arranged in the housing and moves in a main scanning direction, the head unit has a recording head that ejects ink, a relay adapter that supplies ink to the recording head, and an adapter accommodating portion that accommodates the relay adapter, the printer unit further has an ink tube that supplies ink in the ink accommodating portion to the relay adapter, and a discharge port that discharges a recording medium on which recording is performed by the recording head, the scanner unit has a scanner frame, a carriage that is arranged in the scanner frame, has a sensor, and moves in the main scanning direction, a motor that is disposed in the carriage, and a convex portion for the motor that is disposed in the scanner frame, is positioned on the further discharge port side than the head unit, and accommodates the motor, the housing has a facing portion that faces the convex portion for the motor when the scanner unit is in a closed state, and a cover portion that extends to the facing portion and covers a part of the head unit which is positioned in an end portion in the main scanning direction, and a part of the ink tube is positioned in a space that is formed by the cover portion, the facing portion, and the head unit when the head unit is positioned in the end portion in the main scanning direction.

According to a twelfth aspect of the present invention, there is provided the ink jet recording apparatus further including a plurality of the ink tubes, in which an array direction of the plurality of ink tubes is converted from a horizontal direction to an up-and-down direction or from the up-and-down direction to the horizontal direction by an array conversion unit that converts the array direction of the plurality of ink tubes.

According to a thirteenth aspect of the present invention, there is provided the ink jet recording apparatus in which the array conversion unit is disposed in the apparatus.

According to a fourteenth aspect of the present invention, there is provided the ink jet recording apparatus in which the ink accommodating portion is provided outside the housing.

In order to achieve the above-described object, according to a fifteenth aspect of the present invention, there is provided an ink jet recording apparatus including a printer unit, and a scanner unit that is mounted in an openable/closable manner on the printer unit, in which the printer unit has a housing, an ink accommodating portion where ink is accommodated, and a head unit that is arranged in the housing and moves in a main scanning direction, the head unit has a recording head that ejects ink, a relay adapter that supplies ink to the recording head, and an adapter accommodating portion that accommodates the relay adapter, the printer unit further has an ink tube that supplies ink in the ink accommodating portion to the relay adapter, and a discharge port that discharges a recording medium on which recording is performed by the recording head, the adapter accommodating portion has an edge that forms an accommodating port which accommodates the relay adapter, a discharge port side of the edge is formed to be lower than the side of the edge opposite to the discharge port side, the scanner unit has a scanner frame, a carriage that is arranged in the scanner frame, has a sensor, and moves in the main scanning direction, a motor that is disposed in the carriage, and a convex portion for the motor that is disposed in the scanner frame, is positioned on the further discharge port side than the head unit, and accommodates the motor, the housing has a facing portion that faces the convex portion for the motor when the scanner unit is in a closed state, and a cover portion that extends to the facing portion and covers a part of the head unit which is positioned in an end portion in the main scanning direction, and a part of the ink tube extends toward the ink accommodating portion from a gap between the cover portion or the facing portion and the low position at the edge of the adapter accommodating portion when the head unit is positioned in the end portion in the main scanning direction.

According to a sixteenth aspect of the present invention, there is provided the ink jet recording apparatus further including a plurality of the ink tubes, in which an array direction of the plurality of ink tubes is converted from a horizontal direction to an up-and-down direction or from the up-and-down direction to the horizontal direction by an array conversion unit that converts the array direction of the plurality of ink tubes.

According to a seventeenth aspect of the present invention, there is provided the ink jet recording apparatus in which the array conversion unit is disposed in the apparatus.

According to an eighteenth aspect of the present invention, there is provided the ink jet recording apparatus in which the ink accommodating portion is provided outside the housing.

DESCRIPTION OF EMBODIMENTS

Figure 1:
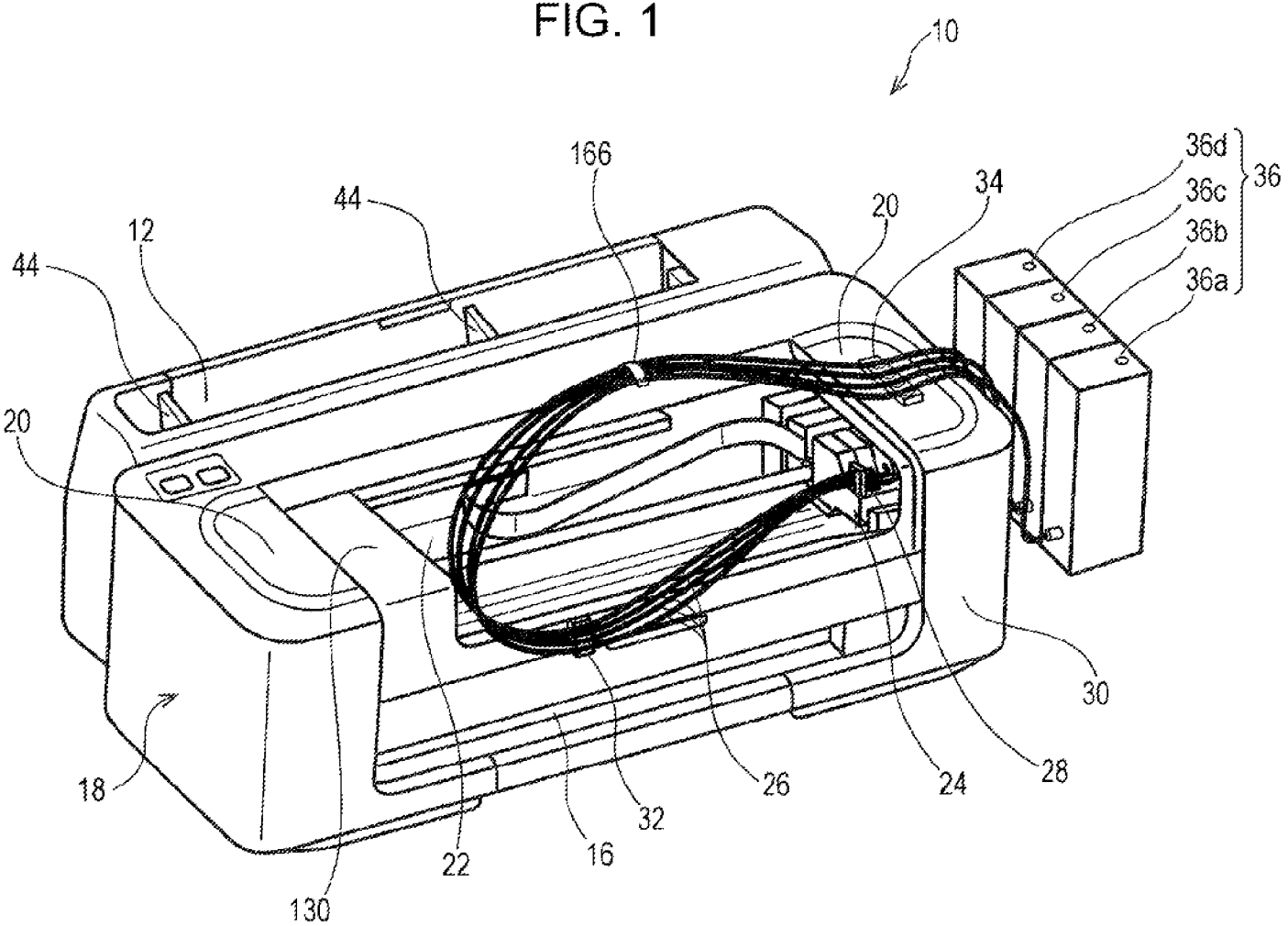
FIG. 1 is a perspective view of an ink jet printer according to the present invention.

Hereinafter, embodiments of the present invention will be described with reference to the accompanying drawings. In the following embodiments, the same reference numerals are attached to the same configurations, and only the foremost embodiment will be described to omit description of the configurations of the subsequent embodiments.

Figure 2:
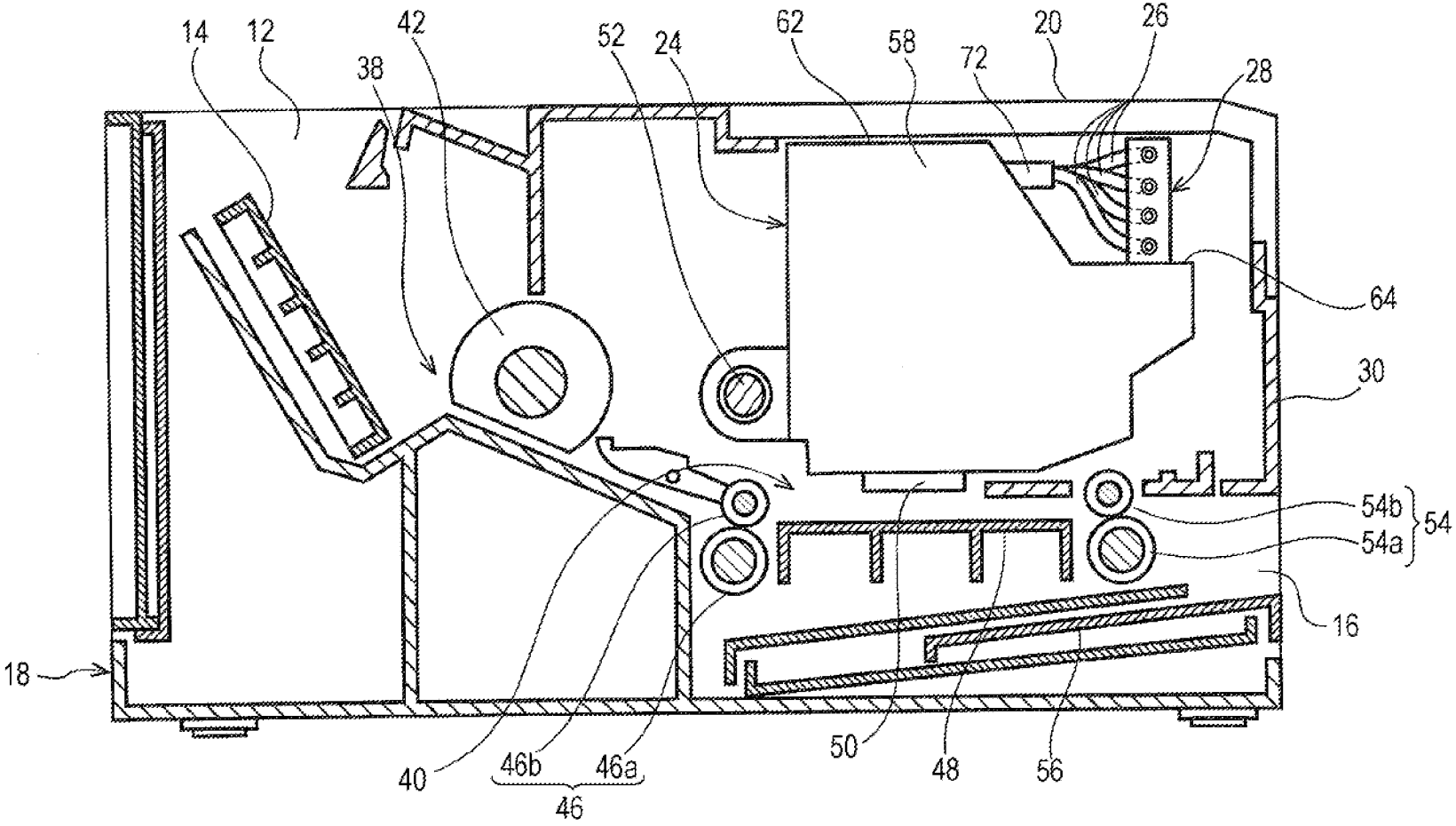
FIG. 2 is a schematic side sectional view illustrating an inner portion of the ink jet printer according to the present invention.
Figure 3:
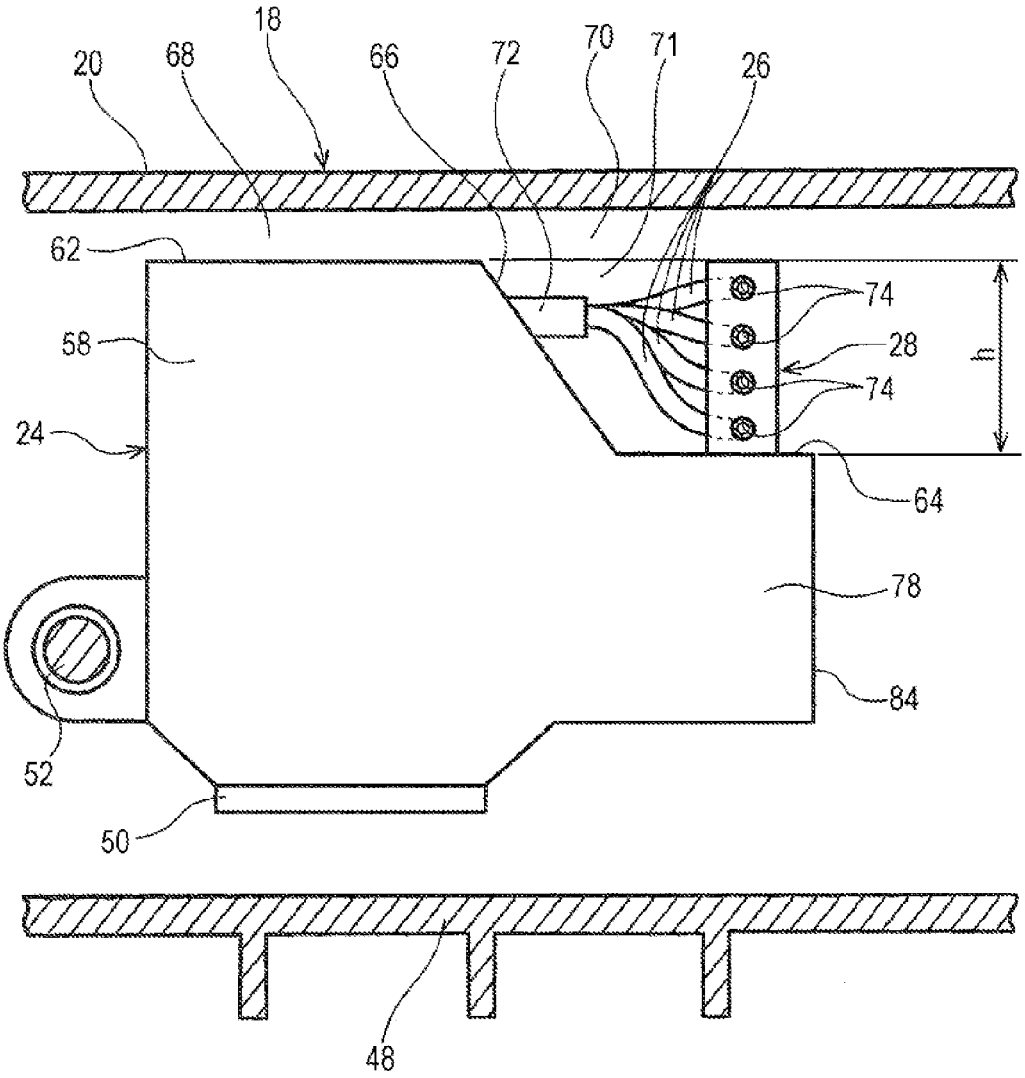
FIG. 3 is a side view of a head unit of a first embodiment.
Figure 4:
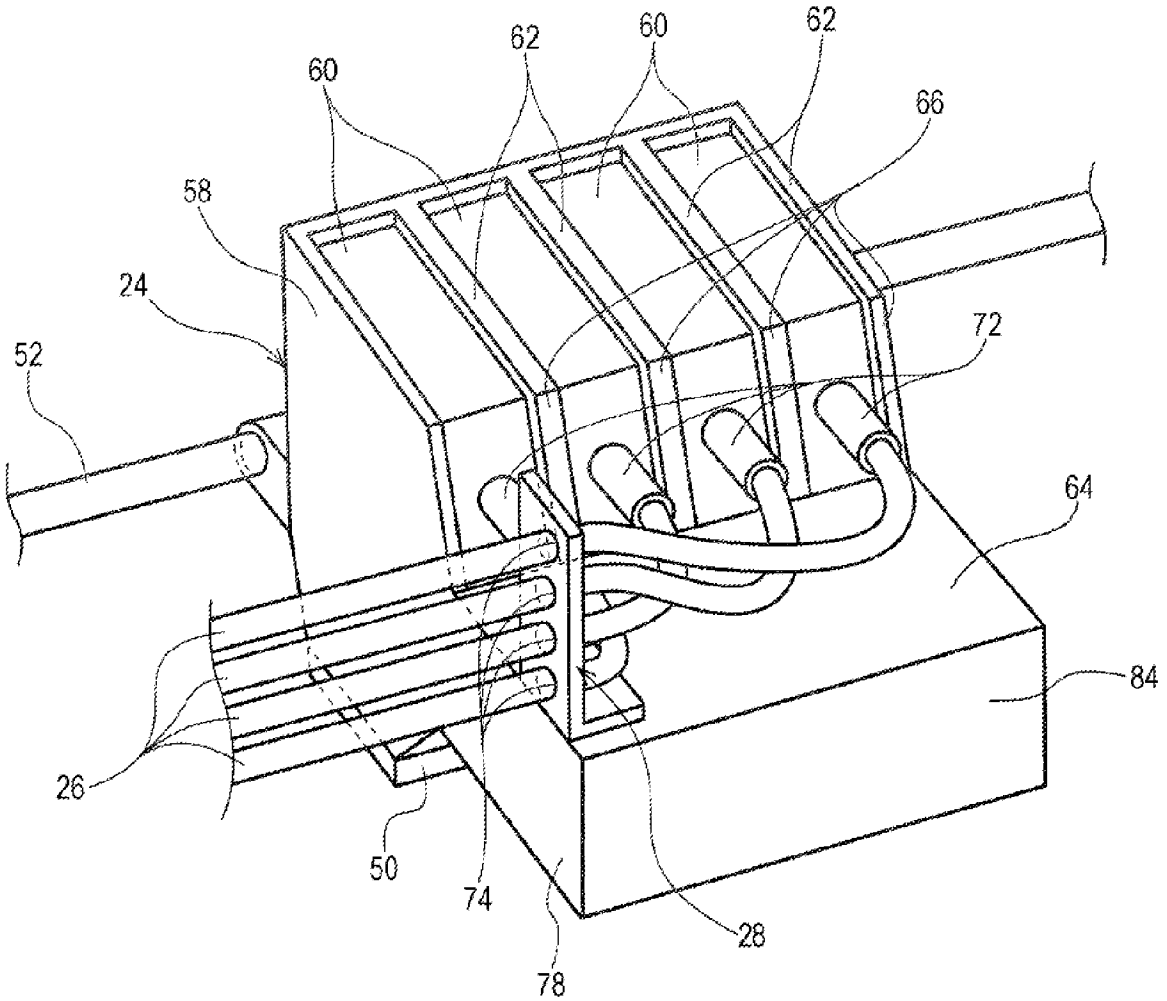
FIG. 4 is a perspective view of the head unit of the first embodiment.

FIG. 1 is a perspective view illustrating an appearance of an ink jet printer as an ink jet recording apparatus according to the present invention. FIG. 2 is a schematic side sectional view illustrating an inner portion of the printer according to the present invention. FIG. 3 is a side view illustrating a head unit of a first embodiment according to the present invention. FIG. 4 is a perspective view illustrating the head unit of the first embodiment. The head unit of the first embodiment is mounted on the ink jet printer illustrated in FIG. 1.

Figure 5:
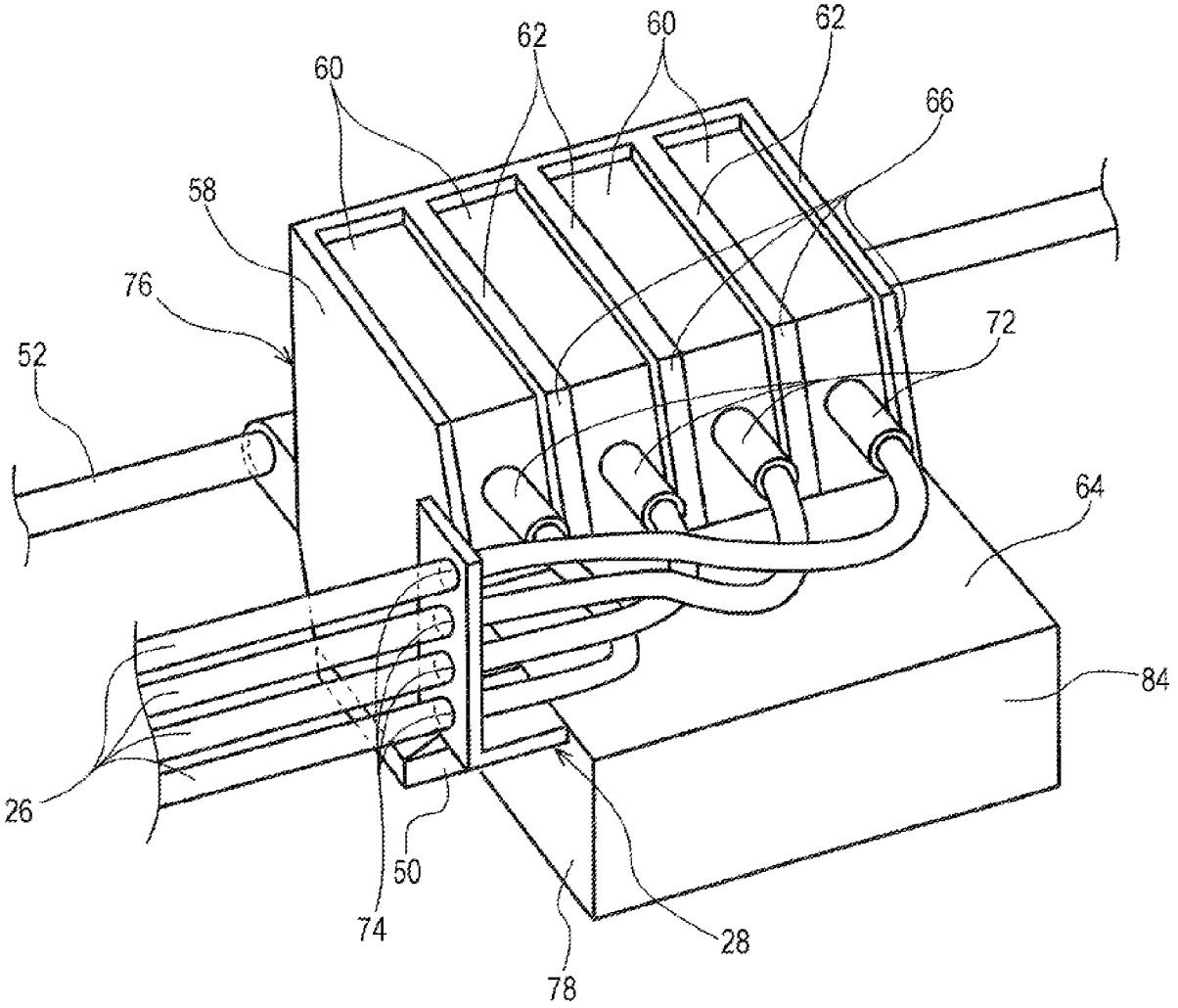
FIG. 5 is a perspective view of a head unit of a second embodiment.
Figure 6:
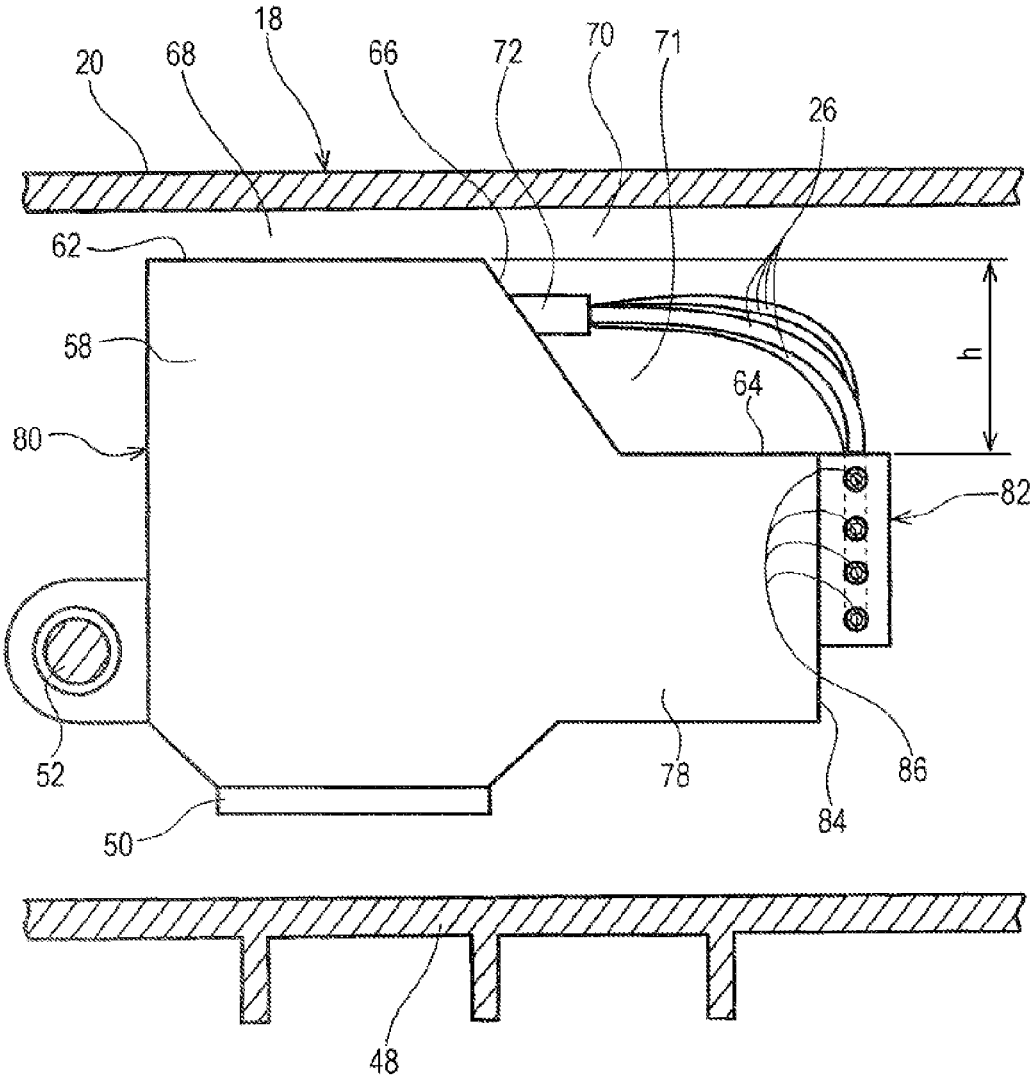
FIG. 6 is a side view of a head unit of a third embodiment.
Figure 7:
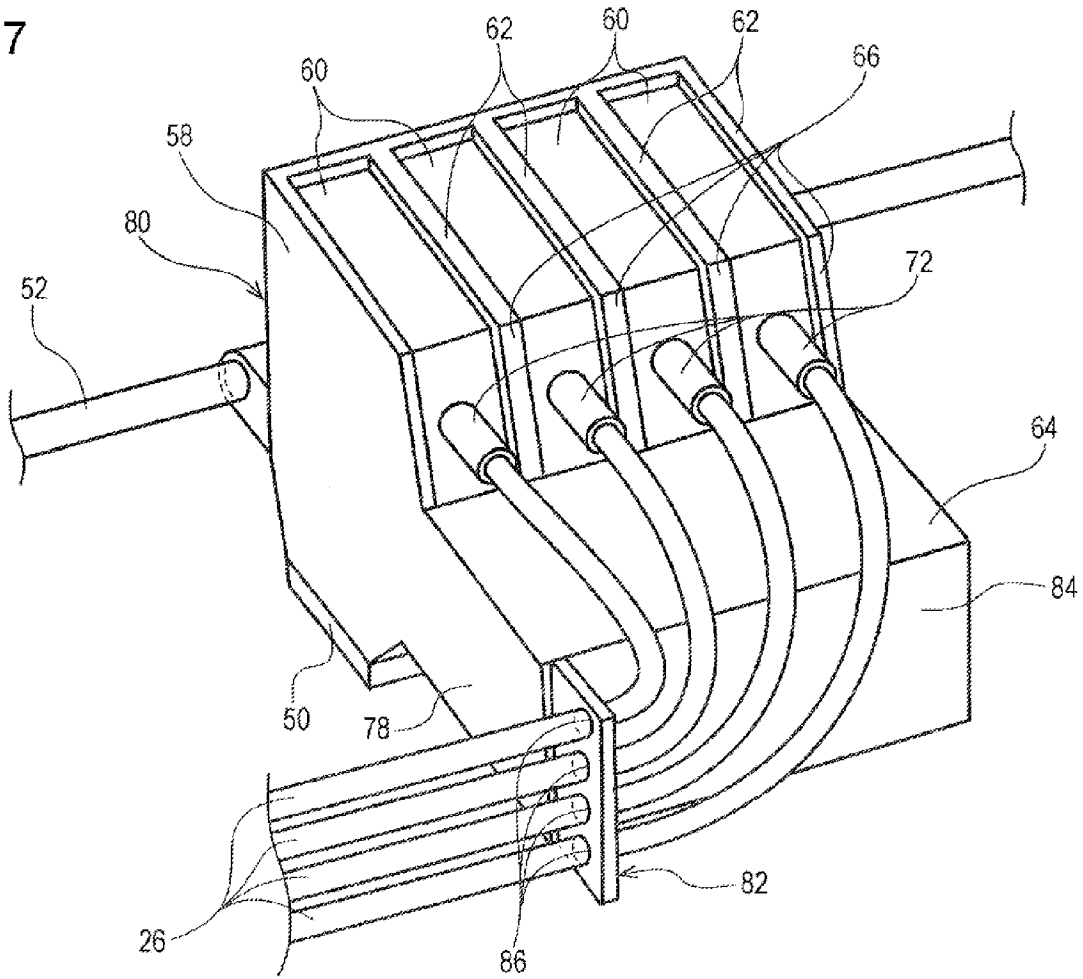
FIG. 7 is a perspective view of the head unit of the third embodiment.
Figure 8:
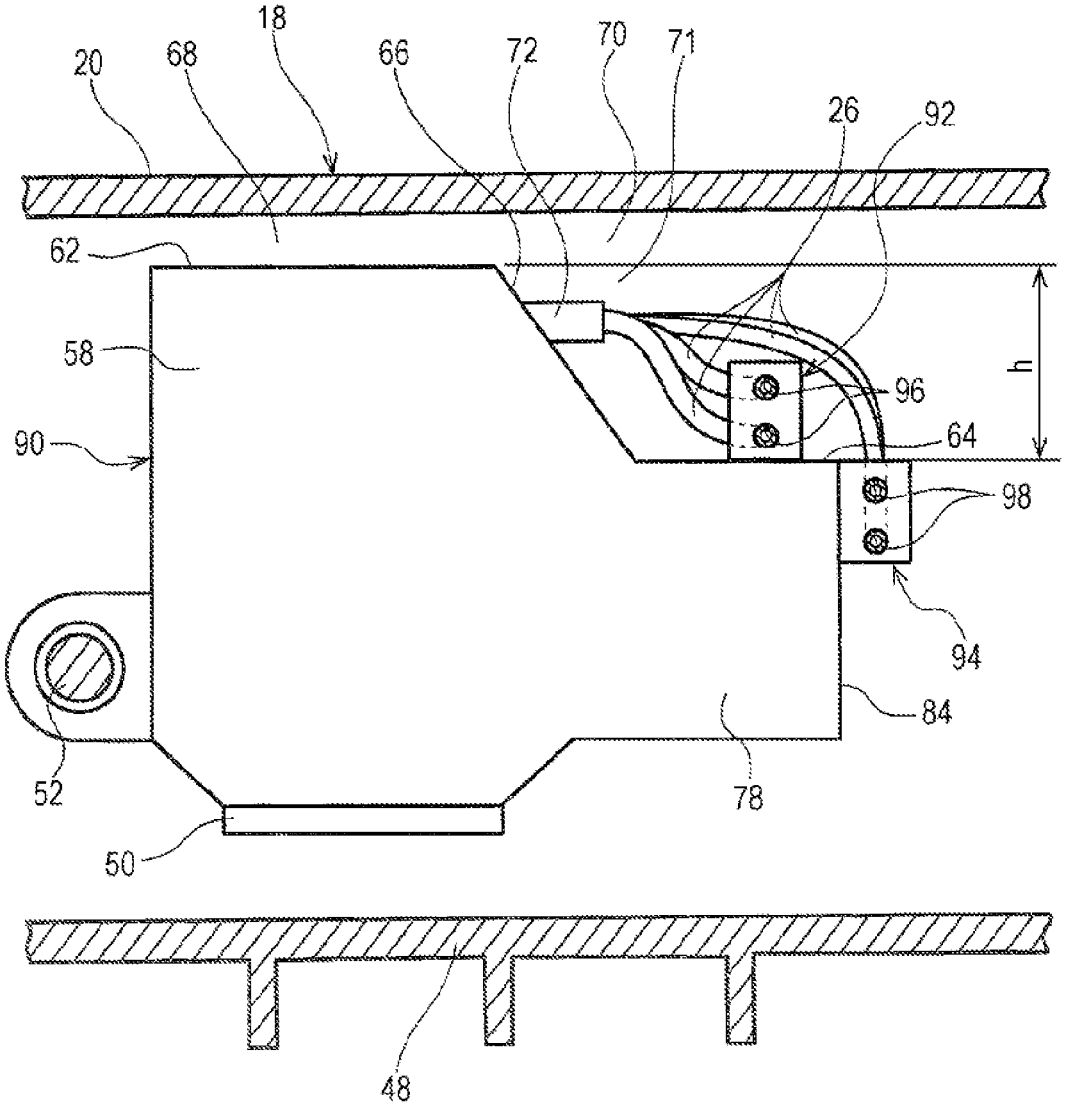
FIG. 8 is a side view of a head unit of a fourth embodiment.
Figure 9:
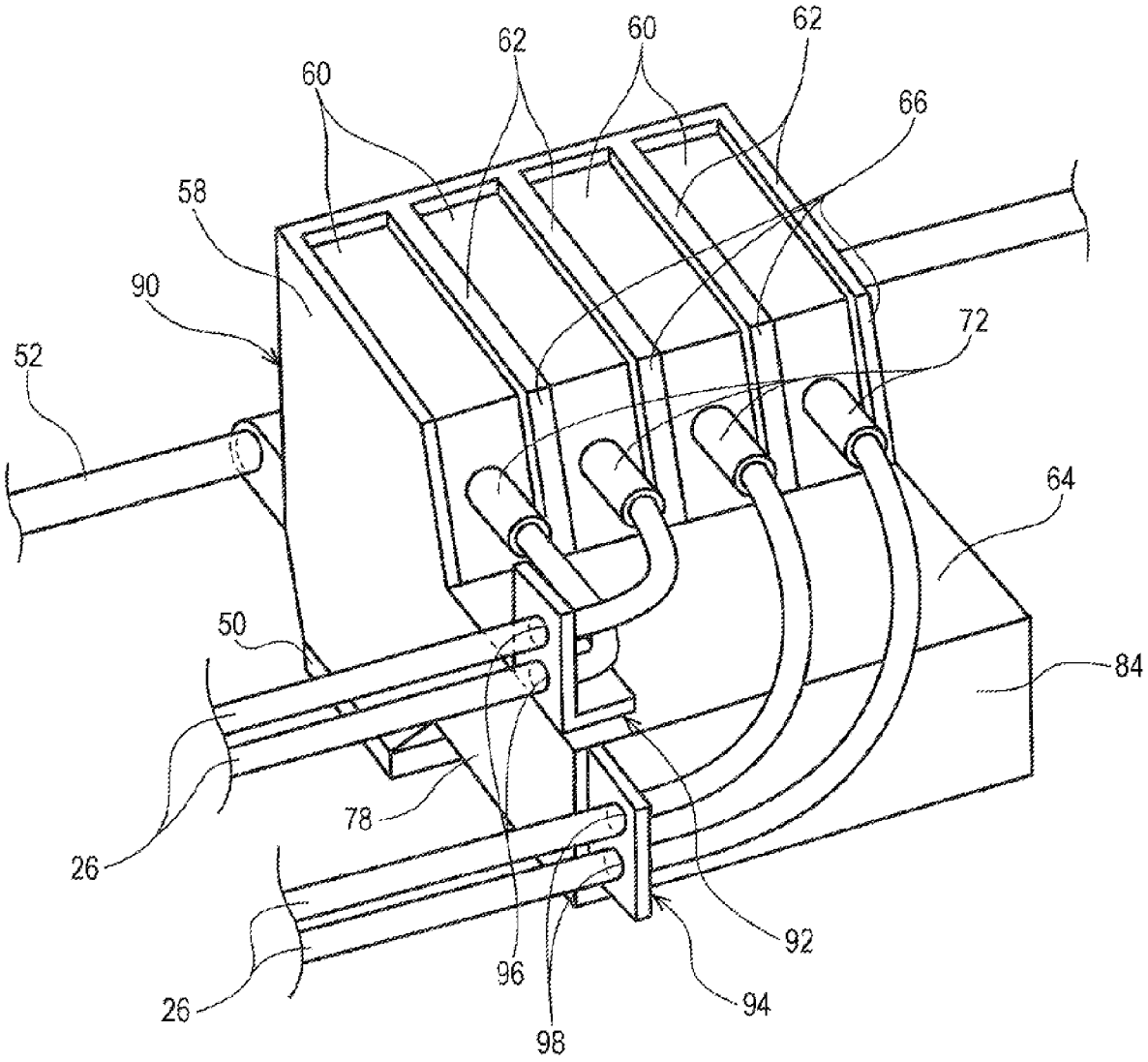
FIG. 9 is a perspective view of the head unit of the fourth embodiment.
Figure 10:
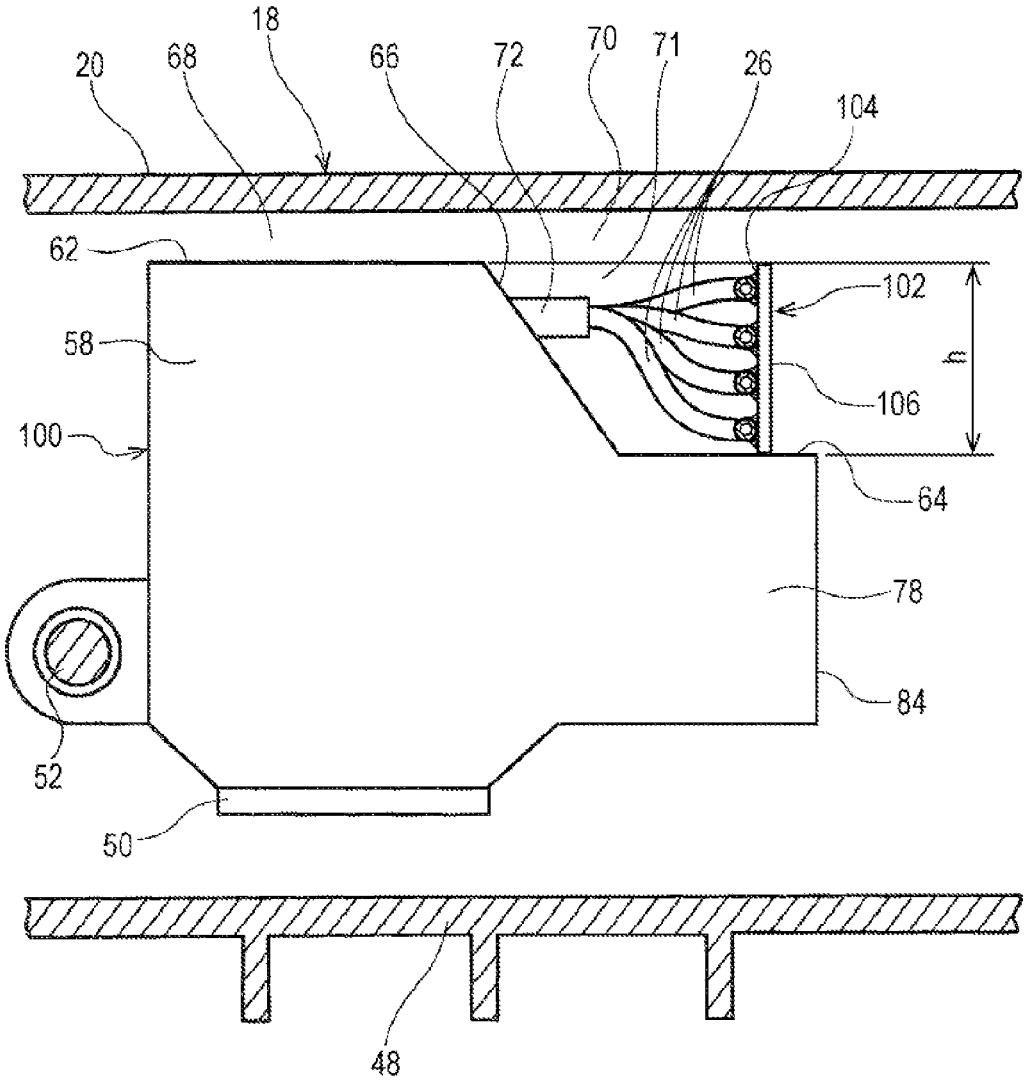
FIG. 10 is a side view of a head unit of a fifth embodiment.
Figure 11:
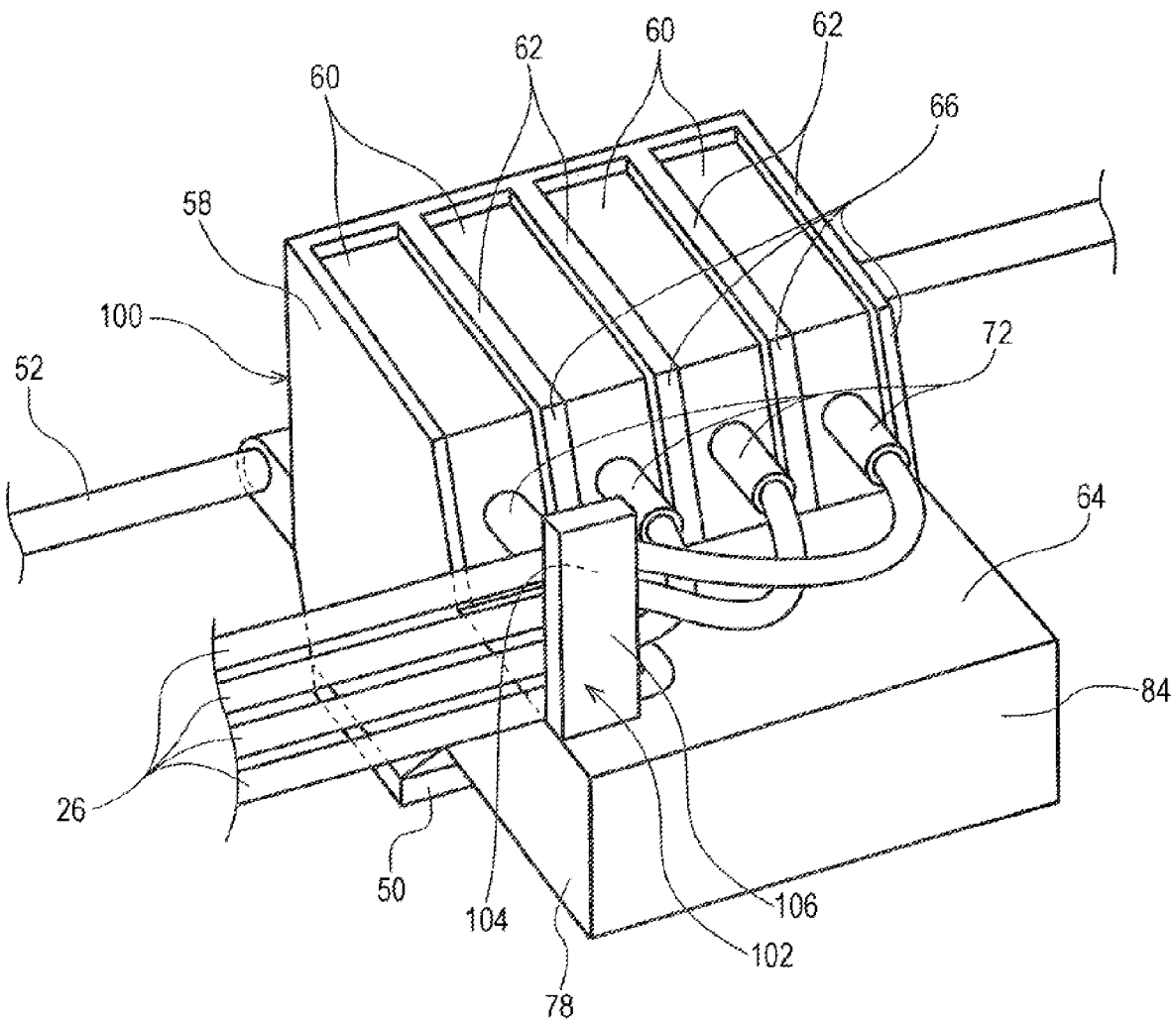
FIG. 11 is a perspective view of the head unit of the fifth embodiment.
Figure 12:
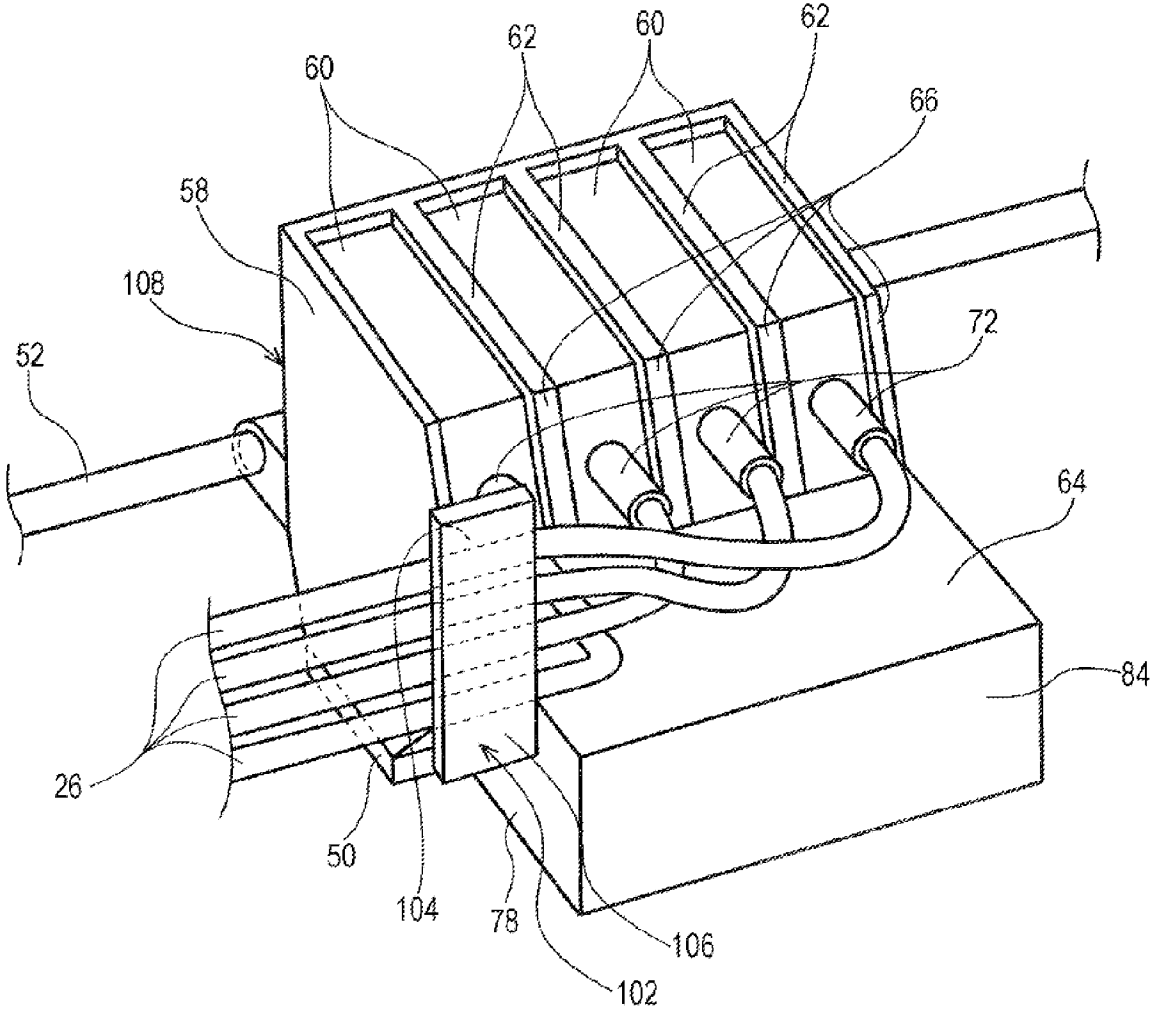
FIG. 12 is a perspective view of a head unit of a sixth embodiment.

FIG. 5 is a perspective view illustrating a head unit of a second embodiment. FIG. 6 is a side view illustrating a head unit of a third embodiment according to the present invention. FIG. 7 is a perspective view illustrating the head unit of the third embodiment. FIG. 8 is a side view illustrating a head unit of a fourth embodiment according to the present invention. FIG. 9 is a perspective view illustrating the head unit of the fourth embodiment. FIG. 10 is a side view illustrating a head unit of a fifth embodiment according to the present invention. FIG. 11 is a perspective view illustrating the head unit of the fifth embodiment. FIG. 12 is a perspective view illustrating a head unit of a sixth embodiment according to the present invention.

Figure 13:
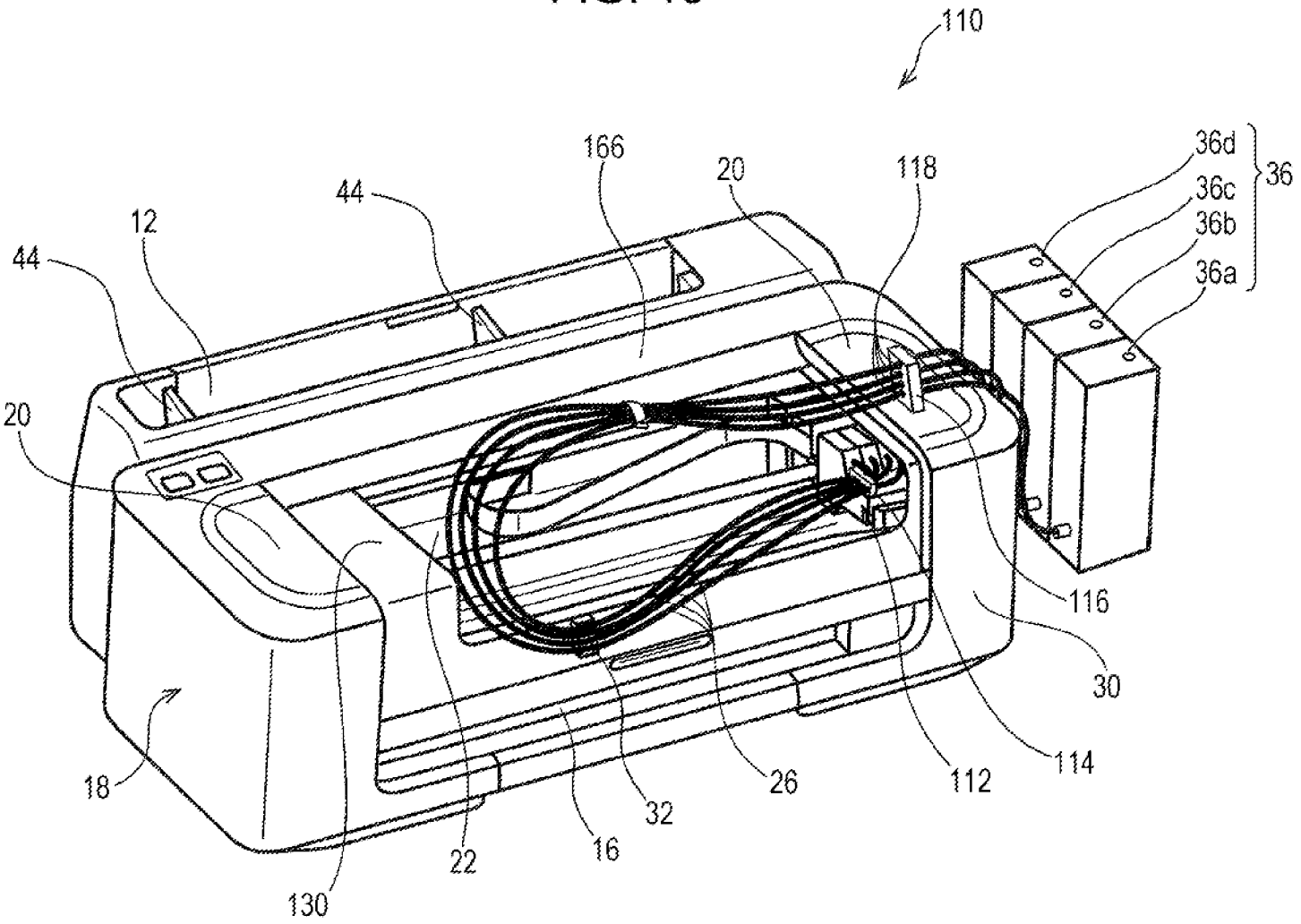
FIG. 13 is a perspective view of an ink jet printer according to a seventh embodiment.
Figure 14:
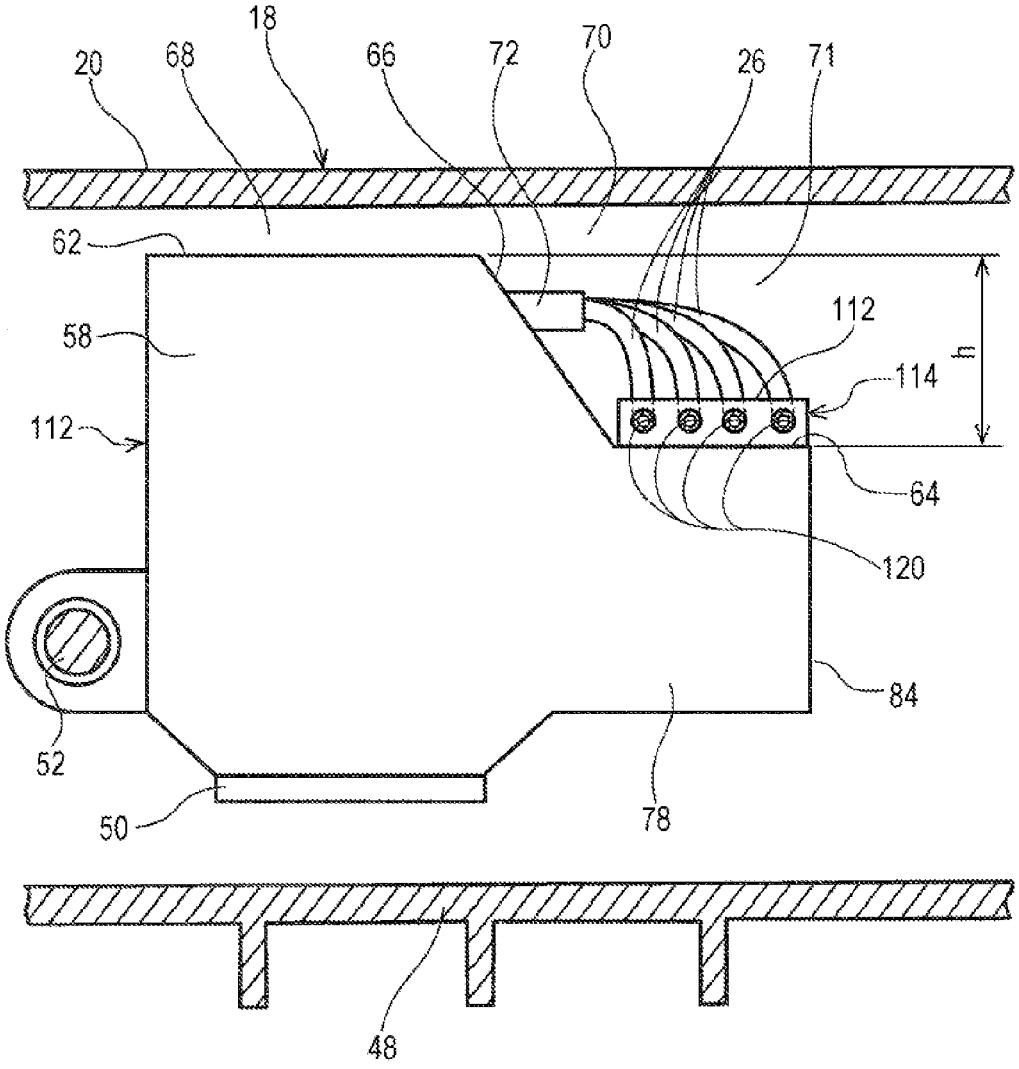
FIG. 14 is a side view of a head unit of the seventh embodiment.
Figure 15:
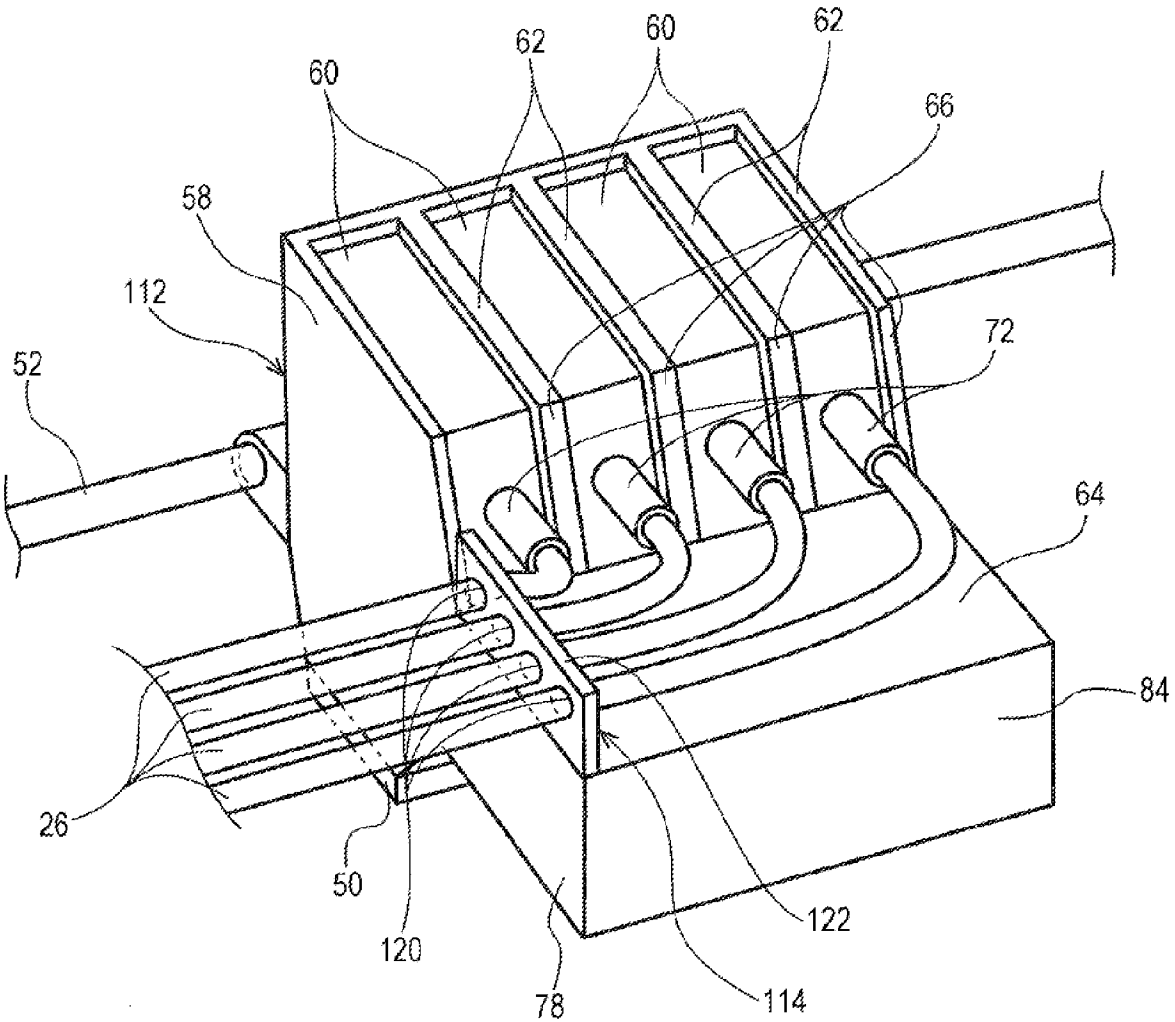
FIG. 15 is a perspective view of the head unit of the seventh embodiment.
Figure 16:
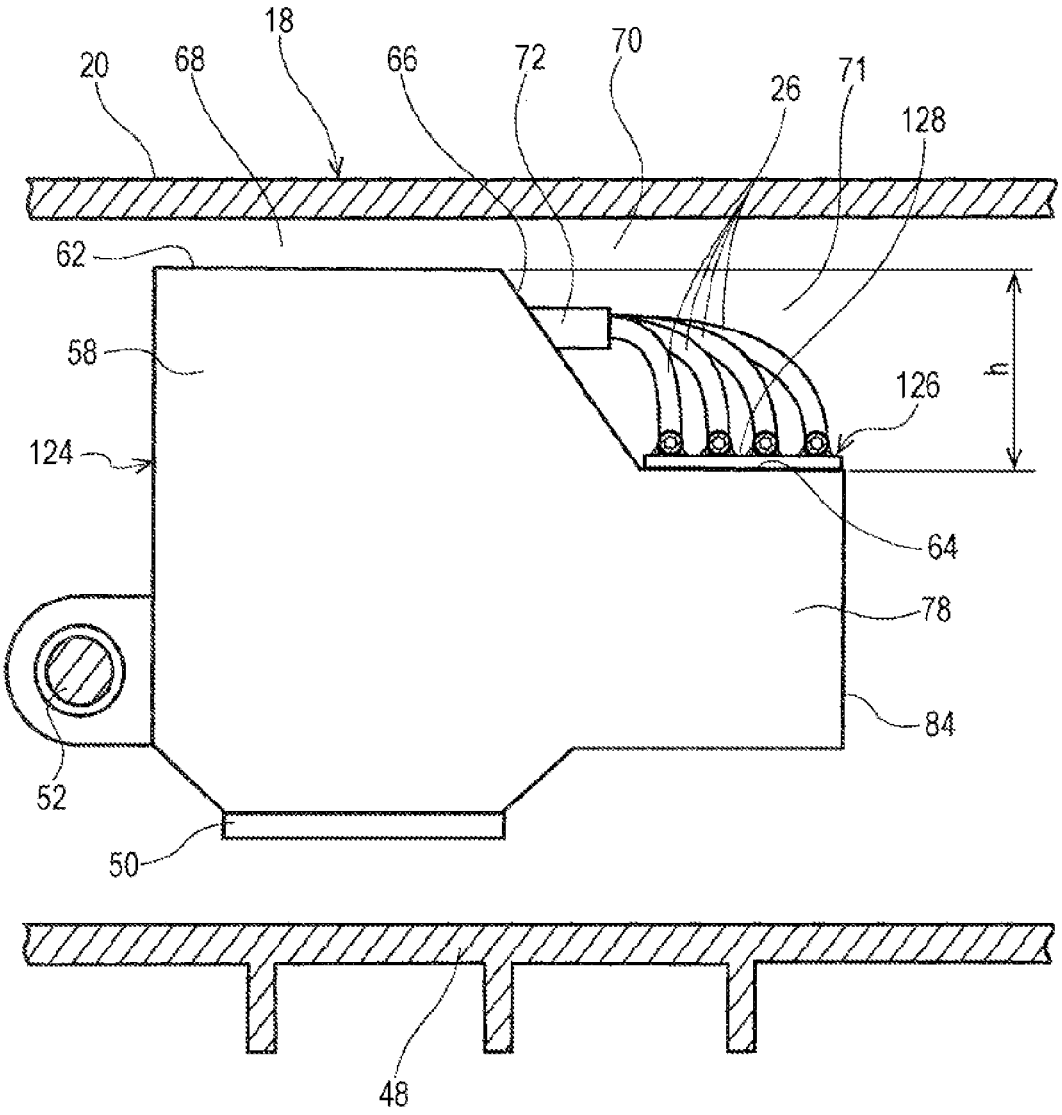
FIG. 16 is a side view of a head unit of an eighth embodiment.
Figure 17:
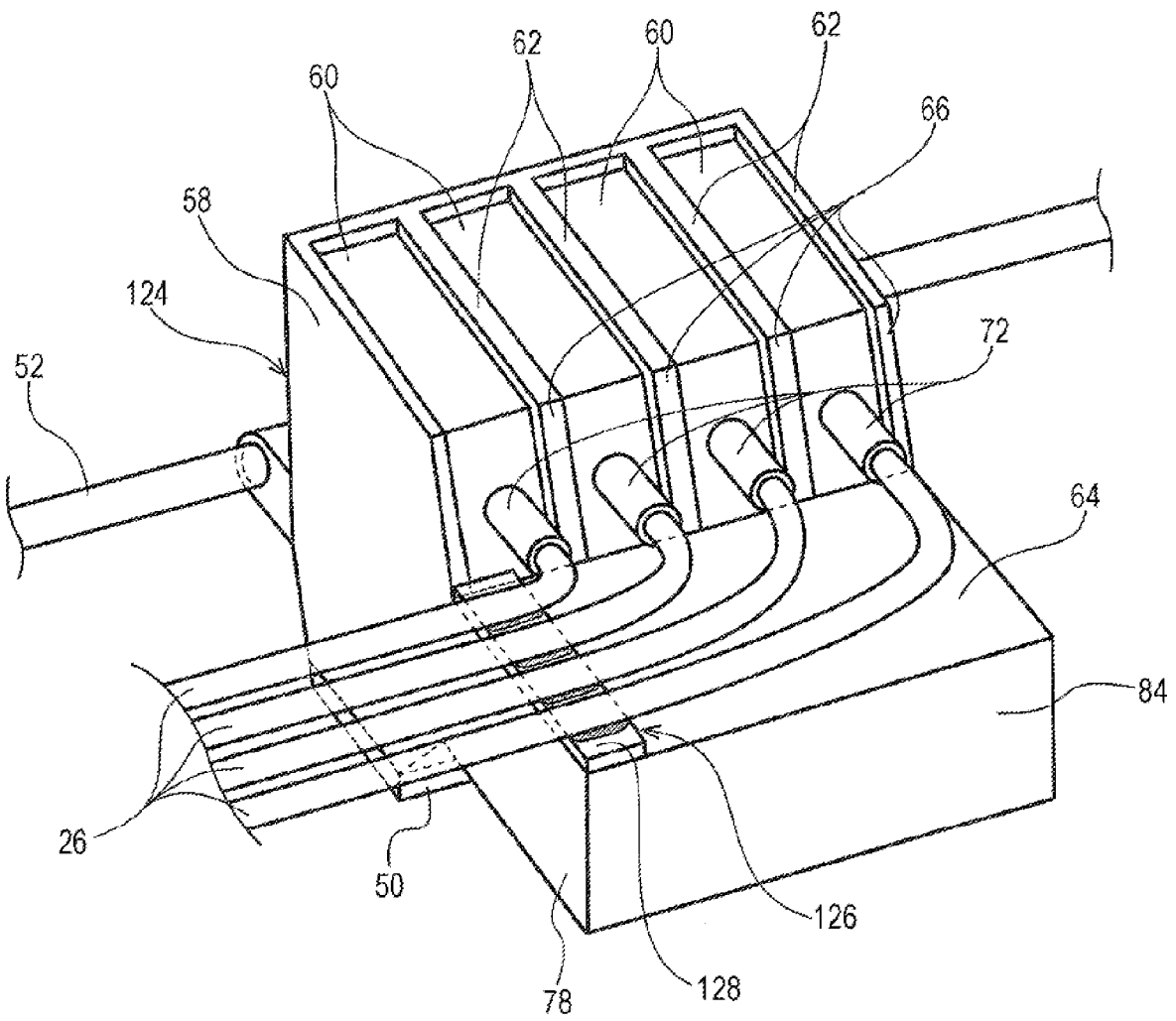
FIG. 17 is a perspective view of the head unit of the eighth embodiment.

FIG. 13 is a perspective view illustrating an appearance of an ink jet printer according to a seventh embodiment. FIG. 14 is a side view illustrating a head unit of the seventh embodiment. FIG. 15 is a perspective view illustrating the head unit of the seventh embodiment according to the present invention. FIG. 16 is a side view illustrating a head unit of an eighth embodiment. FIG. 17 is a perspective view illustrating the head unit of the eighth embodiment.

Figure 18:
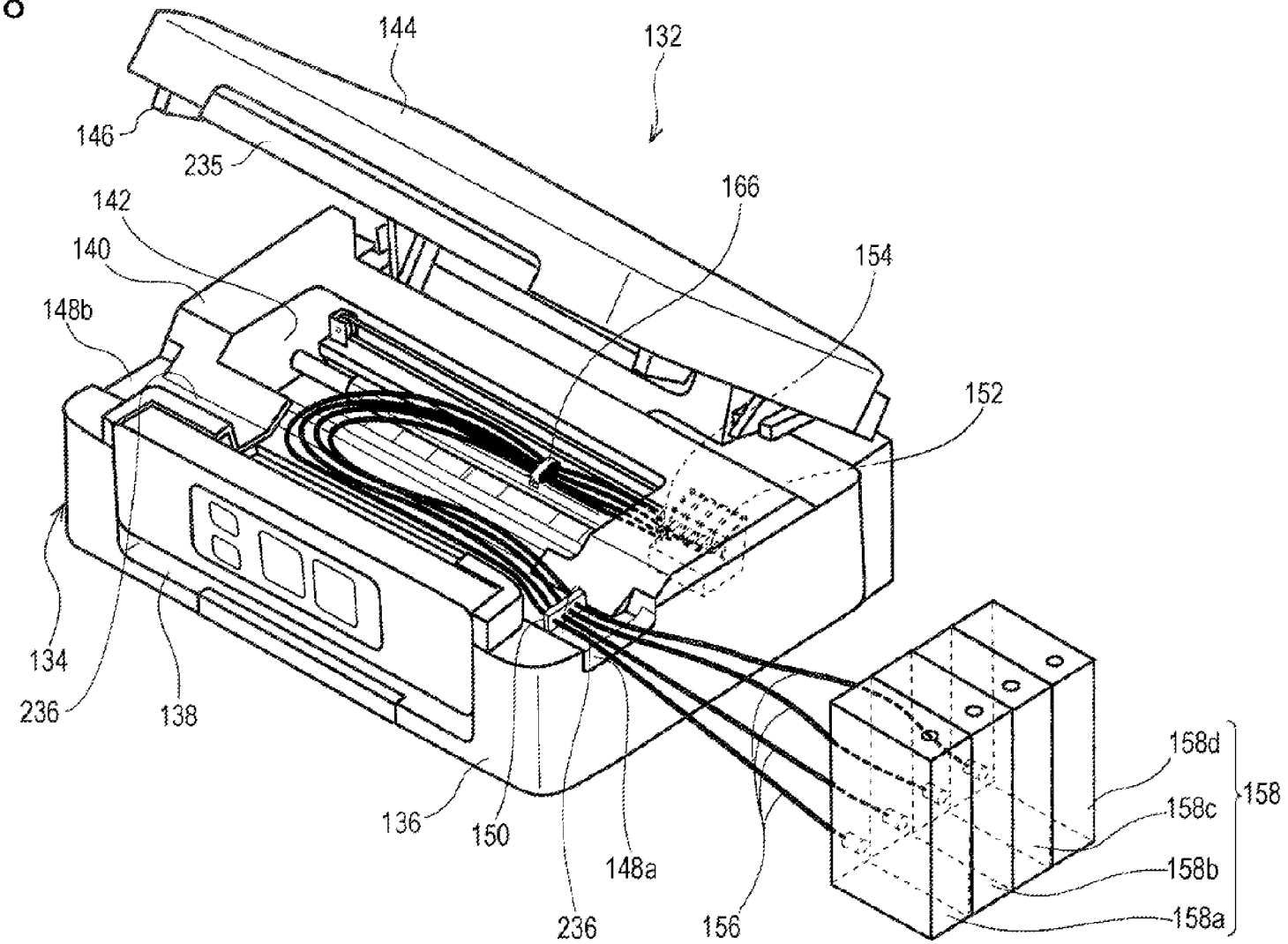
FIG. 18 is a perspective view of an ink jet printer of a ninth embodiment.
Figure 19:
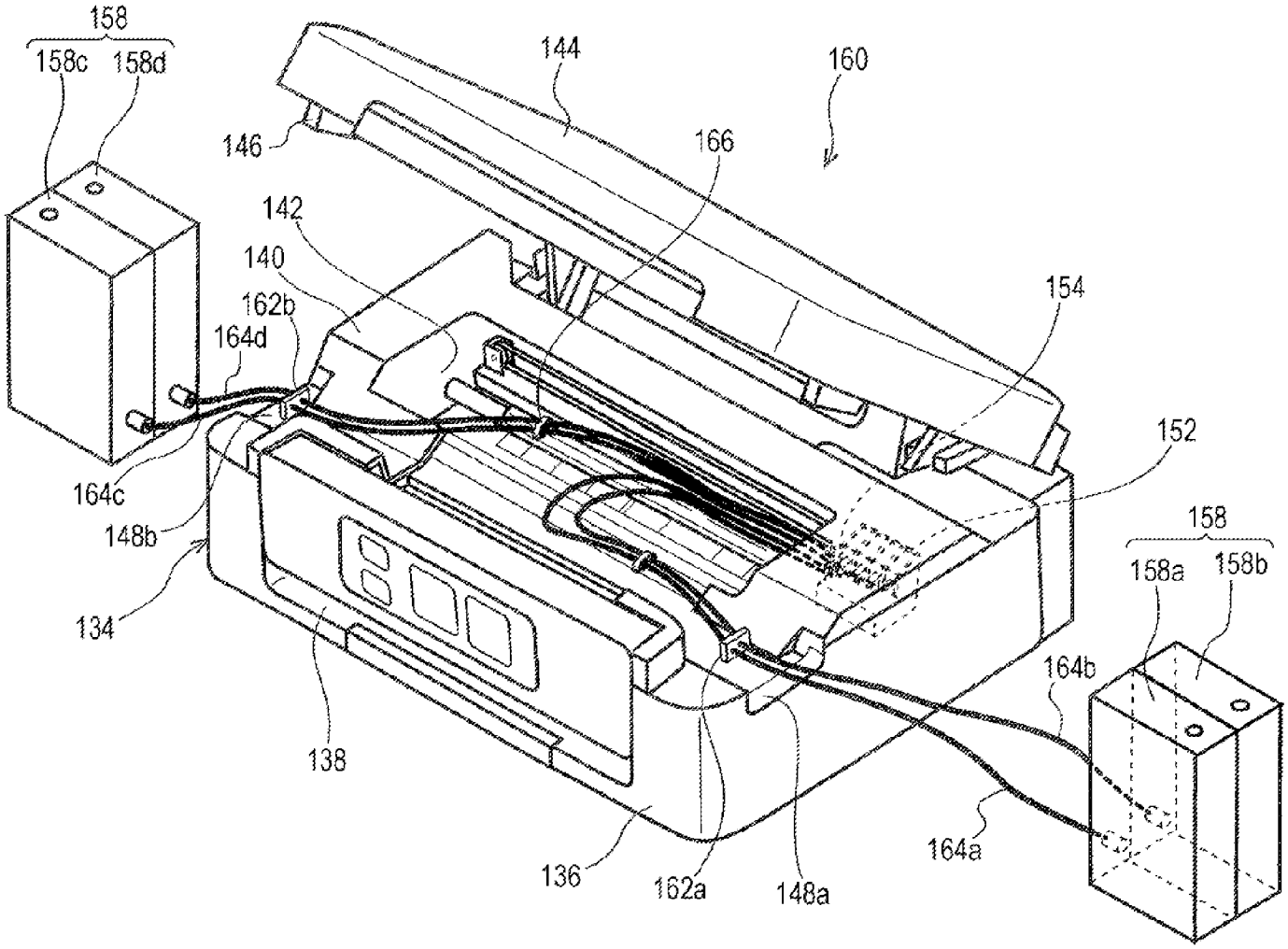
FIG. 19 is a perspective view of an ink jet printer of a tenth embodiment.
Figure 20:
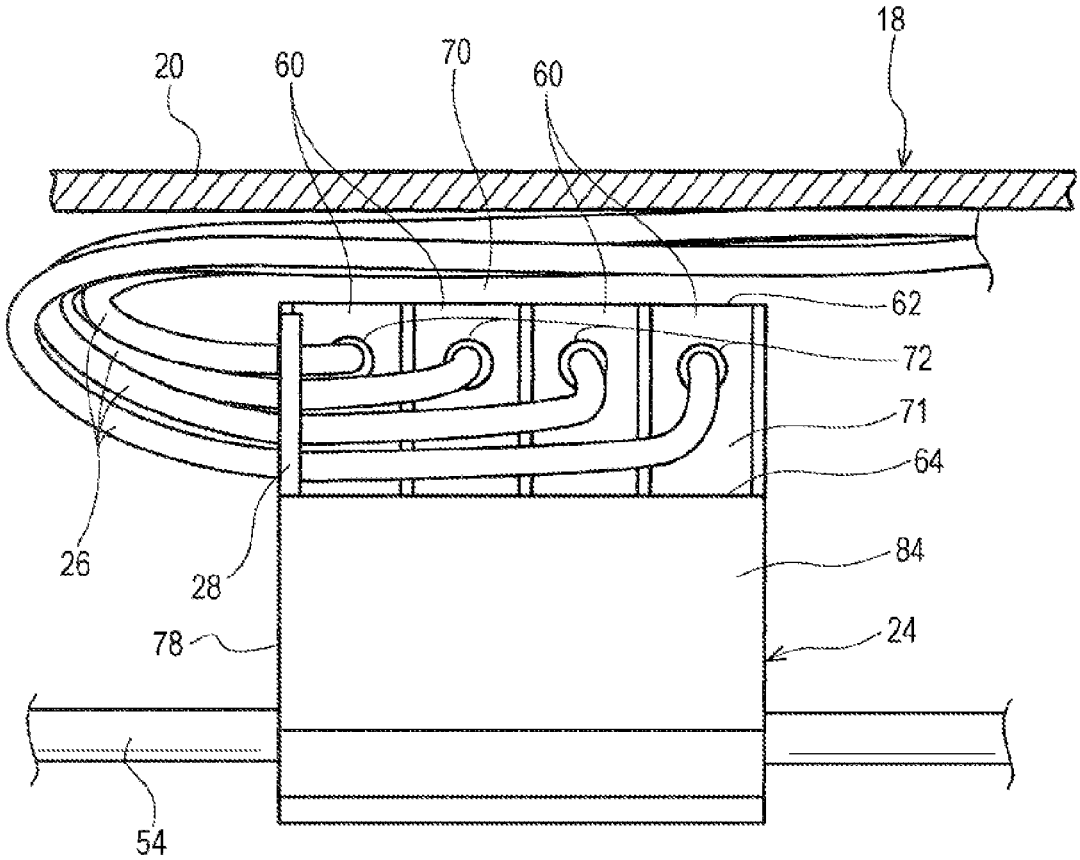
FIG. 20 is a front view of an ink tube arrangement area of an eleventh embodiment.
Figure 21:
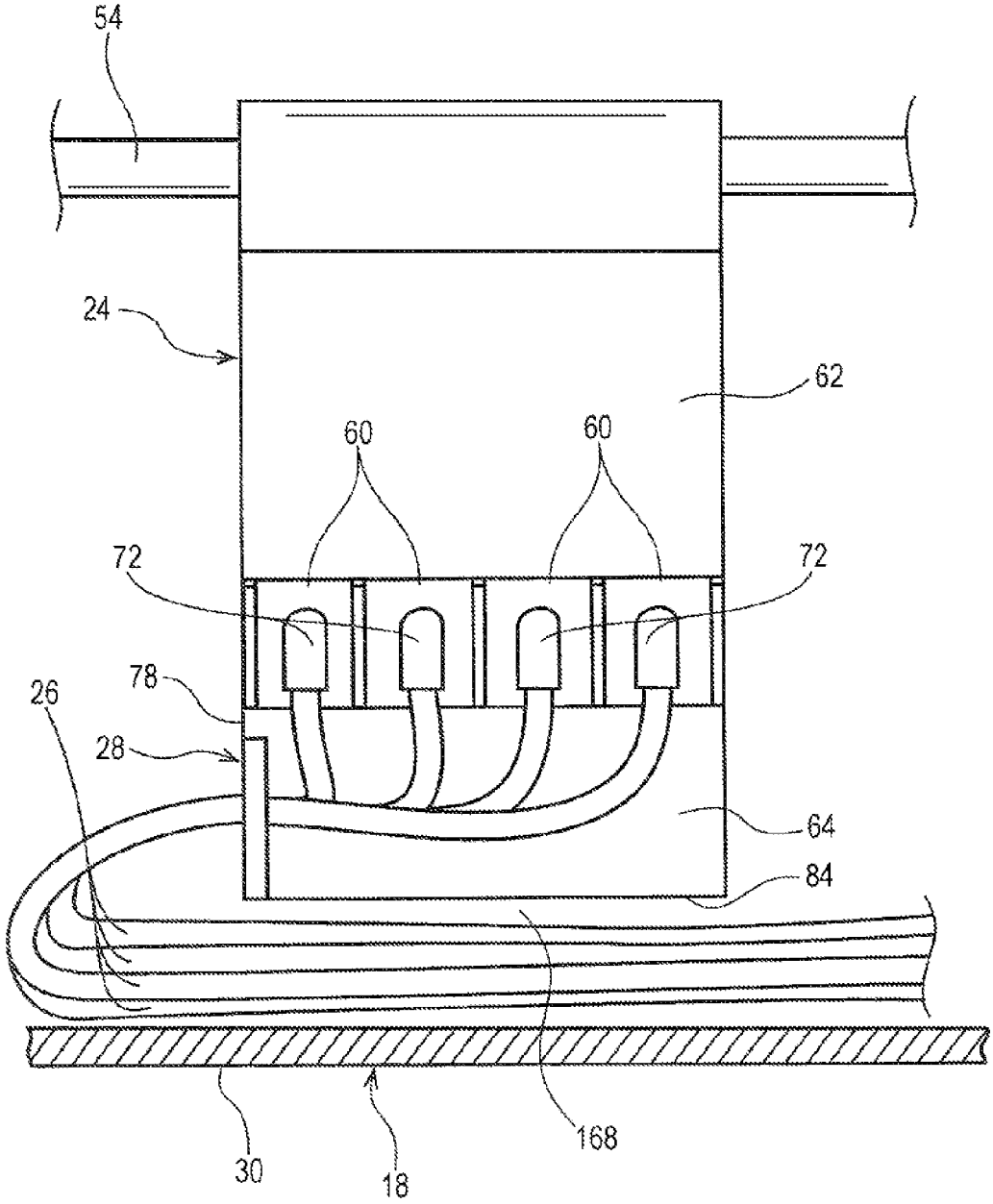
FIG. 21 is a top view of an ink tube arrangement area of a twelfth embodiment.

FIG. 18 is a perspective view illustrating an ink jet printer of a ninth embodiment. FIG. 19 is a perspective view illustrating an ink jet printer of a tenth embodiment. FIG. 20 is a front view of an ink tube arrangement area of an eleventh embodiment. FIG. 21 is a top view of an ink tube arrangement area of a twelfth embodiment.

Figure 24:
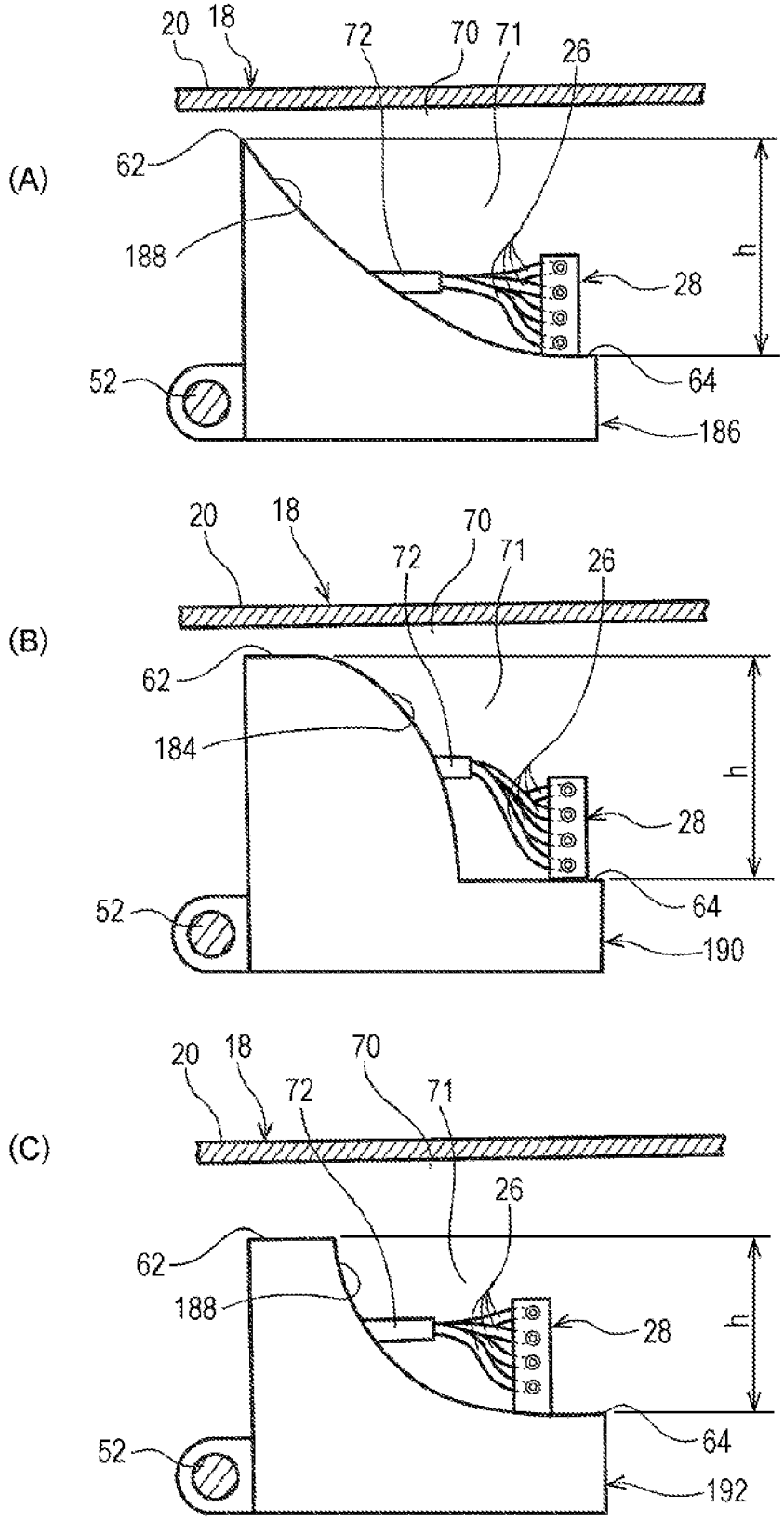
FIGS. 24A, 24B, and 24C are side views of head units of other embodiments.
Figure 25:
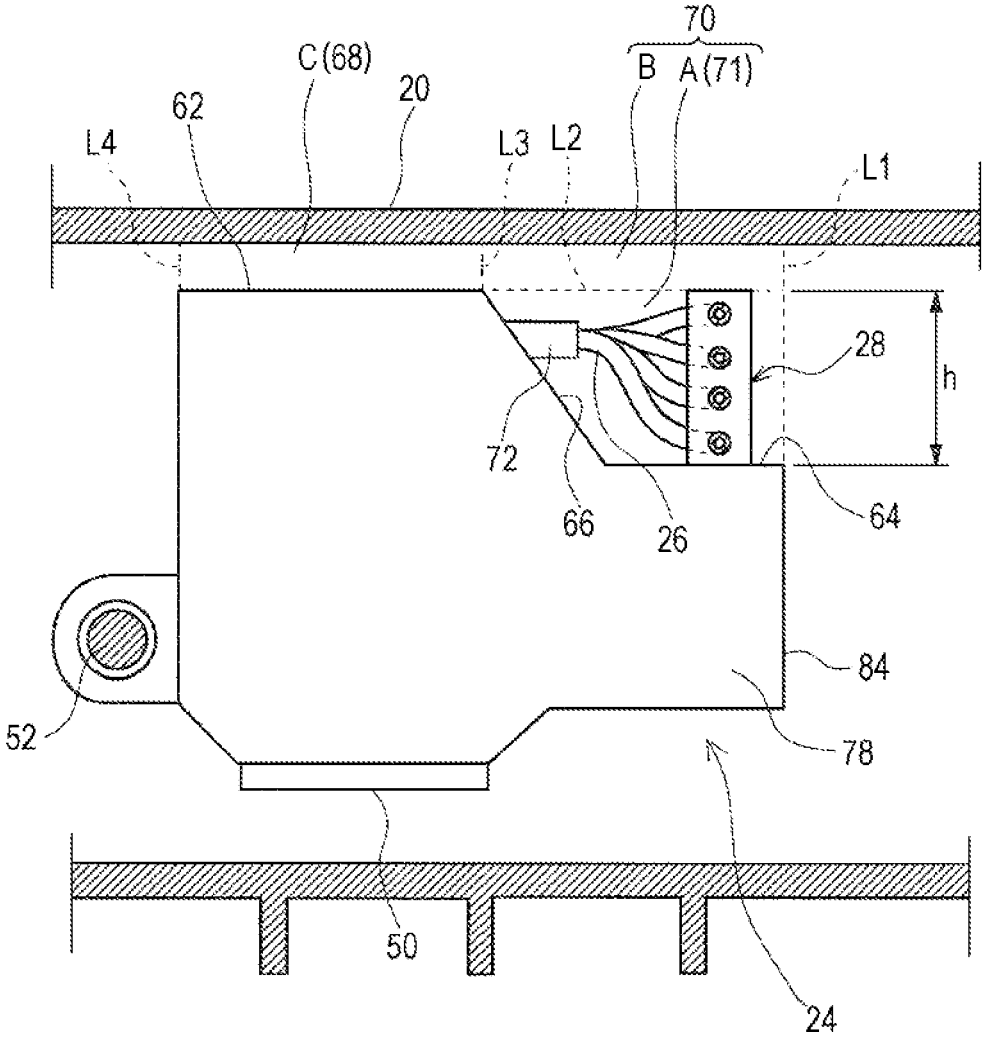
FIG. 25 is a side view illustrating an area in an upper portion of a head unit.

FIG. 22A is a side view of a head unit of a thirteenth embodiment. FIG. 22B is a side view of a head unit of a fourteenth embodiment. FIG. 22C is a side view of a head unit of a fifteenth embodiment. FIG. 23A is a side view of a head unit of a sixteenth embodiment. FIG. 23B is a side view of a head unit of a seventeenth embodiment. FIG. 23C is a side view of a head unit of an eighteenth embodiment. FIG. 24A is a side view of a head unit of a nineteenth embodiment. FIG. 24B is a side view of a head unit of a twentieth embodiment. FIG. 24C is a side view of a head unit of a twenty first embodiment. FIG. 25 is a side view illustrating an area in an upper portion of a head unit.

Each of the side views above is a view of the head unit seen from a direction of movement of the head unit.

Referring to FIG. 1, an appearance of an ink jet printer 10 (hereinafter, referred to as a printer 10) that is an example of an ink jet recording apparatus according to the present invention is illustrated. A recording medium insertion port 12 is disposed on a back surface side (left side on the page surface in FIG. 1) of the printer 10. The recording medium insertion port 12 supplies a recording medium from outside into a hopper 14 (refer to FIG. 2) that is disposed in an inner portion of the printer 10.

In addition, a discharge port 16, which discharges the recording medium on which recording is performed, is disposed on a front surface side (right side on the page surface in FIG. 1) of the printer 10.

Further, a housing 18 constitutes the appearance of the printer 10. The housing 18 has an opening portion 22 that exposes a part of an area of movement of a head unit 24 (described later) in a main scanning direction (long side direction of the printer 10) as the predetermined direction of movement upward and forward, and both sides of the opening portion 22 constitute cover portions 20 that cover the area of movement of the head unit 24 from above. An inner space of the housing 18 is accessible from outside via the opening portion 22. In the present embodiment, the opening portion 22 is in an open state. However, an openable/closable cover may also be disposed so that the opening portion 22 can be in a covered state or the open state.

A plurality of flexible ink tubes 26 have one end sides connected to the head unit 24. The ink tubes 26, which extend from the head unit 24, are aligned in an up-and-down direction (vertical direction) through a guide portion 28 (described later) to extend outside the head unit 24 and extend in the main scanning direction. In the example of FIG. 1, the ink tubes 26 extend to a front surface 30 side of the housing 18 from the vicinity of the center of the opening portion 22 in the main scanning direction, are arranged in the up-and-down direction of the printer 10 in a plate-shaped front surface fixing unit 32 disposed on the front surface 30, and are adhered with an adhesive.

The ink tubes 26 are highly curved in the left of the front surface fixing unit 32, are changed in direction to a right direction, are arranged in a horizontal direction, that is, a front-back direction of the printer 10 in a plate-shaped upper surface fixing unit 34 disposed in the cover portion 20 of the housing 18, and are adhered with the adhesive. The ink tubes 26 extend toward a right side of the housing 18 from the upper surface fixing unit 34.

A plurality of external ink accommodating portions 36*a*, 36*b*, 36*c*, and 36*d* are arranged at separated positions outside the housing 18. The other end sides of the ink tubes 26, which extend from the right side of the housing 18, are respectively connected to the external ink accommodating portions 36*a*, 36*b*, 36*c*, and 36*d*. In the configuration described above, ink is supplied to a recording head 50 from the ink accommodating portions 36*a*, 36*b*, 36*c*, and 36*d* (hereinafter, referred to as the "ink accommodating portion 36" in a case where the respective ink accommodating portions do not have to be distinguished).

In the present embodiment, the ink accommodating portion 36 is configured to be arranged at the separated positions outside the housing 18. However, as another embodiment, the ink accommodating portion 36 may be configured to be disposed integrally with a side surface of the housing 18. This is common to all of the embodiments described below.

In addition, sign 166 is fastening means for fastening the plurality of ink tubes 26 (common to the respective embodiments described below). The fastening means 166 is a fastening band formed of plastic or the like, a rubber-shaped member, or the like. The fastening means 166 is disposed at one place in FIG. 1. However, the fastening means 166 may be disposed at a plurality of places, and the place where the fastening means 166 is disposed can also be set as appropriate. In addition, the fastening means 166 may not be disposed.

Referring to FIG. 2, the hopper 14, where the recording medium is stacked, is disposed on the back surface side of the printer 10 to be capable of oscillating about a fulcrum at an upper part of the hopper 14. The recording medium that is stacked on the top of the hopper 14 is fed to a recording unit 40 on a transport direction downstream side by a feeding unit 38.

Specifically, the recording medium that is stacked on the hopper 14 is picked up by a feed roller 42, which is driven by a feeding motor (not illustrated), and is fed to a pair of transport rollers 46 on the transport direction downstream side while being guided by a pair of recording medium guides 44 (refer to FIG. 1). The recording medium that is fed to the transport rollers 46 is pinched by a main transport roller 46*a* which is driven by a transporting motor (not illustrated) and a driven transport roller 46*b* which follows the movement of the main transport roller 46*a*, and is further transported to the recording unit 40 on the transport direction downstream side.

A medium support member 48 that supports the recording medium from below and a recording head 50 (described later) that is disposed to face an upward side of the medium support member 48 constitute the recording unit 40. The head unit 24 is driven in the main scanning direction to be capable of reciprocating by a head unit motor (not illustrated) while being guided by a head unit guide shaft 52 that extends in the main scanning direction (direction vertical to the page surface in the example of FIG. 2) which is the predetermined direction of movement. Furthermore, the recording head 50, which ejects ink toward the recording medium, is disposed in a bottom surface portion of the head unit 24.

The recording medium, on which the recording is performed by the recording unit 40, is transported to the further downstream side and is transported to a pair of paper discharge rollers 54. The recording medium that is transported to the paper discharge rollers 54 is pinched by a main paper discharge roller 54*a* that is driven by a paper discharge motor (not illustrated) and a driven paper discharge roller 54*b* that follows the movement of the main paper discharge roller 54*a*, and is discharged from the discharge port 16 disposed on the front surface side of the printer 10.

The printer 10 according to the present embodiment further includes a drawable paper discharge guide 56 that is accommodated below the medium support member 48 and the paper discharge rollers 54 and can be drawn to the front surface side of the printer 10.

First Embodiment

Referring to FIGS. 3 and 4, the head unit 24 according to a first embodiment is illustrated. The head unit 24 has an adapter accommodating portion 58. The adapter accommodating portion 58 has a plurality of removable relay adapters 60. The relay adapters 60 and the external ink accommodating portion 36 are connected by the ink tubes 26. As such, ink is supplied from the external ink accommodating portion 36 to the recording head 50 of the head unit 24 through the ink tubes 26 and through the relay adapters 60. Ink is ejected from an ejection nozzle (not illustrated) of the recording head 50 toward the recording medium that is positioned between the recording head 50 and the medium support member 48.

A height difference h is formed in an upper portion of the adapter accommodating portion 58. In a height direction, that is, the up-and-down direction (up-and-down direction on the page surface in FIG. 3) of the head unit 24, a high position in the height difference h is referred to as a high position portion 62 of the adapter accommodating portion 58, and a low position in the height difference h is referred to as a low position portion 64 of the adapter accommodating portion 58. An inclined surface 66 is formed between the high position portion 62 and the low position portion 64.

In addition, the cover portion 20 of the housing 18 covers the head unit 24 from above when a position of the head unit 24 is at a right end or a left end in the main scanning direction. In this case, a first space 68 is generated between the high position portion 62 and the cover portion 20, and a second space 70 is generated between the low position portion 64 and the cover portion 20. The second space 70 is wider than the first space 68.

Herein, to be exact, the first space 68 corresponds to a space C that is illustrated in FIG. 25. The space C is a space that is surrounded by the cover portion 20, the high position portion 62 of the head unit 24, a line L4 (perpendicular line through a back end of the high position portion 62), and a line L3 (perpendicular line through a front end of the high position portion 62) in a state where a part of the head unit 24 or the entire head unit 24 is positioned below the cover portion 20.

In addition, the second space 70 corresponds to a space A+B that is illustrated in FIG. 25. The space A+B is a space that is surrounded by the cover portion 20, the low position portion 64 of the head unit 24, a line L1 (perpendicular line through a front end of the low position portion 64), and the line L3 (perpendicular line through the front end of the high position portion 62) in the state where a part of the head unit 24 or the entire head unit 24 is positioned below the cover portion 20. The space A is a space that is formed between the high position portion 62 and the low position portion 64 in the head unit 24, and, more specifically, is a space that is formed between the line L1, a line L2, and the head unit 24 (hereinafter, the space A is referred to as a third space 71). Even in the other embodiments described below, the specific areas of the first, second, and third spaces are as described above.

In the relay adapters 60, extending portions 72, which protrude toward the second space 70, are disposed between the high position portion 62 and the low position portion 64 in the up-and-down direction. The one end sides of the ink tubes 26 are connected to the extending portions 72. In particular, in the present embodiment, the extending portions 72 are received in the second space 70 and are received in the third space 71 at the same time. In other words, in the present embodiment, the extending portions 72 are positioned not to protrude upward from the head unit 24 in the up-and-down direction and are disposed not to protrude forward (rightward in FIG. 3) from the head unit 24 in the horizontal direction.

The plate-shaped guide portion 28, which protrudes from the low position portion 64 toward the second space 70, that is, the cover portion 20 and extends in the up-and-down direction, is disposed in the low position portion 64. A plurality of holes 74 are disposed in the guide portion 28 to be aligned in the up-and-down direction to be open in the main scanning direction. The ink tubes 26, which are connected to the extending portions 72, pass through the respective holes 74 of the guide portion 28. The ink tubes 26 are aligned in the up-and-down direction by the guide portion 28, and the direction of extension thereof is guided in the main scanning direction. The guide portion 28 also functions as defining means for defining the direction of extension of the ink tubes 26.

An accommodating port is formed in the adapter accommodating portion 58 illustrated in FIG. 4 so that the relay adapters 60 can be removed. The accommodating port is an opening portion of the adapter accommodating portion 58 that is surrounded by an edge of the high position portion 62, an edge of the inclined surface 66, and an edge of the low position portion 64 on a back end side. The ink tubes 26 extend toward the ink accommodating portion 36 from a gap between the cover portion 20 and an edge of the adapter accommodating portion 58 at the low position (low position portion 64) when the head unit 24 is positioned in an end portion in the main scanning direction.

According to the present embodiment, the extending portions 72, where the ink tubes 26 extend, are received in the second space 70 as described above when the head unit 24 is seen from the direction of movement of the head unit 24 (FIGS. 3 and 25), and also received in the third space 71 in the present embodiment. Accordingly, the second space 70 and the third space 71 can be effectively used, and the ink jet recording apparatus can be compact in size. This is common to the other embodiments described below.

In the present embodiment, the extending portions 72 are disposed to be received in an area A illustrated in FIG. 25. However, a part of the extending portions 72 may be disposed to be received in an area B. Alternatively, a part of the extending portions 72 may be positioned to the right side from the straight line L1 illustrated in FIG. 25. In other words, according to the present invention, the extending portions 72 use the area A and the scope of the present invention is satisfied insofar as the area A is used by at least a part of the extending portions 72. This is common to the other embodiments described below.

In addition, according to the present embodiment, the guide portion 28 as well as the extending portions 72 is received in the second space 70 and is received in the third space 71 at the same time. In other words, in the present embodiment, the guide portion 28 is positioned not to protrude upward from the head unit 24 in the up-and-down direction and is disposed not to protrude forward (rightward in FIG. 3) from the head unit 24 in the horizontal direction. In this manner, the apparatus can be further compact in size.

Second Embodiment

FIG. 5 illustrates a second embodiment. The difference of the present embodiment from the first embodiment described above is that the guide portion 28 protrudes out of a head unit 76 in the main scanning direction from a left end surface 78 of the head unit 76 as illustrated in FIG. 5. The other configuration is the same as that of the first embodiment described above.

<<<Modification Example of First and Second Embodiments>>>

The first and second embodiments described above may be further modified as follows.

(1) The ink tubes 26 pass through the holes 74 of the guide portion 28. However, the ink tubes 26 may be configured to be mounted on semicircular notches, instead of the holes 74, by using the adhesive or the like.

(2) The ink tubes 26 may be fixed to the holes 74 of the guide portion 28 by using the adhesive or the like, and may simply pass through the holes 74 without being fixed.

(3) The direction of extension of the ink tubes 26 from the housing 18 in FIG. 1 may be toward the left side of the housing 18. In addition, in conjunction with this configuration, the upper surface fixing unit 34 may also be configured to be disposed at a site 130 that is adjacent to a left end side of the cover portion 20 of the housing 18 or a left end side of the opening portion 22. Additionally, the ink accommodating portion 36 may also be arranged on a left side of the apparatus.

(4) In FIG. 1, the ink tubes 26 are adhered and fixed to the plate-shaped upper surface fixing unit 34 that is disposed in the cover portion 20 of the housing 18. However, the ink tubes 26 may be fixed directly to the cover portion 20 of the housing 18.

(5) The guide portion 28 may be fixed to the low position portion 64 of the head unit by using the adhesive, may be attached and fixed thereto by using an adhesive material, may be screw-fixed thereto, and various fixing methods can be employed.

(6) In FIG. 1, the ink tubes 26 extend to the front surface 30 side of the housing 18 and are adhered and fixed via the plate-shaped front surface fixing unit 32 that is disposed on the front surface 30, but the ink tubes 26 may be fixed directly, not via the front surface fixing unit 32, to the front surface 30 of the housing 18. In addition, various methods such as adhesion and the use of an adhesive material can be employed, as described above, as the methods for fixing the front surface fixing unit 32 to the housing 18 and the method for fixing the ink tubes 26 to the front surface fixing unit 32.

(7) Furthermore, the ink tubes 26 may not be fixed between the head unit 24 and the upper surface fixing unit 34 (the upper surface fixing unit 34 may not be disposed). In this case, sections of the ink tubes 26 at the head unit 24 and the upper surface fixing unit 34 are sections that are deformed in response to a moving operation of the head unit 24. In the example of FIG. 1, a part of the deformed sections are in a state of upward protrusion from an upper surface of the housing 18.

Third Embodiment

Referring to FIGS. 6 and 7, a head unit 80 according to a third embodiment is illustrated. The third embodiment differs from the first embodiment in that a guide portion 82 is disposed on a front surface 84 of the head unit 80.

The plate-shaped guide portion 82 is disposed on the front surface 84 of the head unit 80. The guide portion 82 protrudes from the front surface 84 and extends in the up-and-down direction. A plurality of holes 86 are disposed in the guide portion 82 to be aligned in the up-and-down direction to be open in the main scanning direction. The ink tubes 26, which are connected to the extending portions 72, pass through the respective holes 86 of the guide portion 82. The ink tubes 26 are aligned in the up-and-down direction by the guide portion 82 and the direction of extension thereof is guided in the main scanning direction.

<<<Modification Example of Third Embodiment>>>

The third embodiment described above may be further modified as follows.

(1) The ink tubes 26 pass through the holes 86 of the guide portion 82. However, the ink tubes 26 may be configured to be mounted on semicircular notches, instead of the holes 86, by using the adhesive or the like.

(2) The ink tubes 26 may be fixed to the holes 86 of the guide portion 82 by using the adhesive or the like, and may simply pass through the holes 86 without being fixed.

(3) The guide portion 82 may be fixed to the front surface 84 of the head unit 80 by using the adhesive, may be attached and fixed thereto by using the adhesive material, may be screw-fixed thereto, and various fixing methods can be employed.

(4) In the present embodiment, the ink tubes 26 are fixed to the front surface 84 of the head unit 80 via the guide portion 82, but the ink tubes 26 may be fixed directly to the front surface 84 of the head unit 80. In addition, various methods such as adhesion and the use of the adhesive material can be employed in this case as the method for fixing the ink tubes 26. In addition, the fixing means such as the adhesive and the adhesive material used in this case constitutes the defining means for defining the direction of extension of the ink tubes 26.

(5) As illustrated in the second embodiment (FIG. 5), the guide portion 82 may be configured to protrude in the main scanning direction from the left end surface 78 of the head unit outside the head unit.

Fourth Embodiment

Referring to FIGS. 8 and 9, a head unit 90 according to a fourth embodiment is illustrated. The fourth embodiment differs from the first embodiment in that a first guide portion 92 is disposed in the low position portion 64 of the head unit 90 and a second guide portion 94 is disposed on the front surface 84 of the head unit 90.

The first guide portion 92, which protrudes from the low position portion 64 to the second space 70, that is, upward and extends in the up-and-down direction, is disposed in the low position portion 64 of the head unit 90. A plurality of holes 96 are disposed in the first guide portion 92 to be aligned in the up-and-down direction to be open toward the main scanning direction.

Some of the ink tubes 26 extending from the extending portions 72 of the relay adapters 60 pass through the respective holes 96 of the first guide portion 92. The ink tubes 26 that pass through the holes 96 of the first guide portion 92 are aligned in the up-and-down direction by the first guide portion 92, and the direction of extension thereof is guided in the main scanning direction.

In addition, the second guide portion 94, which protrudes forward from the front surface 84 and extends in the up-and-down direction, is disposed on the front surface 84 of the head unit 90. A plurality of holes 98 are disposed in the second guide portion 94 to be aligned in the up-and-down direction to be open toward the main scanning direction.

The other ink tubes 26, which do not pass through the holes 96 of the first guide portion 92, pass through the respective holes 98 of the second guide portion 94. The ink tubes 26 that pass through the holes 98 of the second guide portion 94 are aligned in the up-and-down direction by the second guide portion 94, and the direction of extension thereof is guided in the main scanning direction.

<<<Modification Example of Fourth Embodiment>>>

The fourth embodiment described above may be further modified as follows.

(1) The ink tubes 26 pass through the holes 96 and 98 of the guide portions 92 and 94. However, the ink tubes 26 may be configured to be mounted on semicircular notches, instead of the holes 96 and 98, by using the adhesive or the like.

(2) The ink tubes 26 may be fixed to the holes 96 and 98 of the guide portions 92 and 94 by using the adhesive or the like, and may simply pass through the holes 96, 98 without being fixed.

(3) The guide portions 92 and 94 may be fixed to the front surface 84 of the head unit 80 by using the adhesive, may be attached and fixed thereto by using the adhesive material, may be screw-fixed thereto, and various fixing methods can be employed.

(4) In the present embodiment, the ink tubes 26 are fixed to the front surface 84 of the head unit 80 via the guide portion 94, but the ink tubes 26 may be fixed directly to the front surface 84 of the head unit 80. In addition, various methods such as adhesion and the use of the adhesive material can be employed in this case as the method for fixing the ink tubes 26.

(5) As illustrated in the second embodiment (FIG. 5), the guide portions 92 and 94 may be configured to protrude in the main scanning direction from the left end surface 78 of the head unit outside the head unit.

Fifth Embodiment

Referring to FIGS. 10 and 11, a head unit 100 according to a fifth embodiment is illustrated. The fifth embodiment differs from the first embodiment in that the direction of extension of the ink tubes 26 is defined by defining means 102 instead of the guide portion 28.

The defining means 102 is disposed in the low position portion 64 of the head unit 100. The defining means 102 is a plate-shaped member that protrudes from the low position portion 64 to the second space 70, that is, upward and extends in the up-and-down direction. On a surface 104 of the defining means 102 that faces the extending portions 72, the ink tubes 26 are adhered with the adhesive to be aligned in the up-and-down direction. The ink tubes 26, which are connected to the extending portions 72, are aligned in the up-and-down direction by the defining means 102, and the direction of extension thereof is guided in the main scanning direction.

<<<Modification Example of Fifth Embodiment>>>

The fifth embodiment described above may be further modified as follows.

(1) The ink tubes 26 may be attached to the facing surface 104 by using an adhesion member such as a double-sided tape instead of mounting the ink tubes 26 on the facing surface 104 by using the adhesive. Furthermore, as another embodiment, the ink tubes 26 may be mounted on a surface 106 on the side opposite to the facing surface 104.

(2) The defining means 102 may be fixed to the low position portion 64 of the head unit by using the adhesive, may be attached and fixed thereto by using the adhesive material, may be screw-fixed thereto, and various fixing methods can be employed.

(3) As illustrated in the second embodiment (FIG. 5), the defining means 102 may be configured to protrude in the main scanning direction from the left end surface 78 of the head unit outside the head unit.

Sixth Embodiment

FIG. 12 illustrates a sixth embodiment. The present embodiment differs from the fifth embodiment described above in that the defining means 102 protrudes out of the head unit 108 in the main scanning direction from the left end surface 78 of a head unit 108 as illustrated in FIG. 12. The other configuration is the same as that of the fifth embodiment described above.

Seventh Embodiment

Referring to FIG. 13, a printer 110 according to a seventh embodiment is illustrated. The difference of the printer 110 from the printer 10 of the first embodiment lies in the configuration of a guide portion 114 disposed in a head unit 112 and an upper surface fixing unit 116 disposed in the cover portion 20 of the housing 18.

The plurality of flexible ink tubes 26 have the one end sides connected to the head unit 112. The ink tubes 26, which extend from the head unit 112, are aligned in the horizontal direction, that is, the front-back direction of the printer 110 through the guide portion 114 (described later) to extend in the main scanning direction. The ink tubes 26 extend to the front surface 30 side of the housing 18 from the vicinity of the center of the opening portion 22 in the main scanning direction, are arranged in the up-and-down direction of the printer 110 in the plate-shaped front surface fixing unit 32 disposed on the front surface 30, and are adhered with the adhesive. In other words, the front surface fixing unit 32 is array conversion means (array conversion unit), and an array direction of the ink tubes 26 is converted from the horizontal direction to the up-and-down direction. The front surface fixing unit 32 that constitutes the array conversion means is disposed outside the apparatus, but may also be disposed inside the apparatus.

The ink tubes 26 are highly curved in the left of the front surface fixing unit 32, and extend to the plate-shaped upper surface fixing unit 116 that is disposed in the cover portion 20 of the housing 18. The upper surface fixing unit 116 is a plate-shaped member that protrudes upward from the cover portion 20 and extends in the up-and-down direction. A plurality of holes 118 are disposed in the upper surface fixing unit 116 to be aligned in the up-and-down direction to be open in the main scanning direction. The ink tubes 26, which extend from the front surface fixing unit 32 pass through the respective holes 118 of the upper surface fixing unit 116. The ink tubes 26 are aligned in the up-and-down direction by the upper surface fixing unit 116, and extend toward the right side of the housing 18 from the upper surface fixing unit 116.

The plurality of external ink accommodating portions 36*a*, 36*b*, 36*c*, and 36*d* are arranged at the separated positions outside the housing 18. The other end sides of the ink tubes 26, which extend from the right side of the housing 18, are respectively connected to the external ink accommodating portions 36*a*, 36*b*, 36*c*, and 36*d*.

Referring to FIGS. 14 and 15, the head unit 112 according to the seventh embodiment is illustrated. The difference from the first embodiment lies in that the ink tubes 26 are arranged in the guide portion 114 not in the up-and-down direction but in the horizontal direction, that is, the front-back direction (right-and-left direction on the page surface in FIG. 14).

The plate-shaped guide portion 114, which protrudes from the low position portion toward the second space 70, that is, the cover portion 20 and extends in the horizontal direction, is disposed in the low position portion 64. A plurality of holes 120 are disposed in the guide portion 114 to be aligned in the horizontal direction to be open toward the main scanning direction. The ink tubes 26, which are connected to the extending portions 72, pass through the respective holes 120 of the guide portion 114. The ink tubes 26 are aligned in the horizontal direction by the guide portion 114, and the direction of extension thereof is guided in the main scanning direction.

<<<Modification Example of Seventh Embodiment>>>

The seventh embodiment described above may be further modified as follows.

(1) The ink tubes 26 pass through the holes 120 of a guide portion 114. However, the ink tubes 26 may be configured to be mounted on semicircular notches, instead of the holes 120, by using the adhesive or the like.

(2) The ink tubes 26 may be fixed to the holes 120 of the guide portion 114 by using the adhesive or the like, and may simply pass through the holes 120 without being fixed.

(3) The direction of extension of the ink tubes 26 from the housing 18 in FIG. 13 may be toward the left side of the housing 18. In addition, in conjunction with this configuration, the guide portion 114 also may be configured to be disposed at the site 130 that is adjacent to the left end side of the cover portion 20 of the housing 18 or the left end side of the opening portion 22. Additionally, the ink accommodating portion 36 may also be arranged on the left side of the apparatus.

(4) In FIG. 13, the ink tubes 26 extend to the front surface 30 side of the housing 18 and are adhered and fixed via the plate-shaped front surface fixing unit 32 that is disposed on the front surface 30, but the ink tubes 26 may be fixed directly, not via the front surface fixing unit 32, to the front surface 30 of the housing 18. In addition, various methods such as adhesion and the use of the adhesive material can be employed, as described above, as the methods for fixing the front surface fixing unit 32 or the guide portion 114 to the housing 18 and as the methods for fixing the ink tubes 26 to the front surface fixing unit 32.

(5) Some of the plurality of ink tubes 26 may be configured to be disposed on the front surface 84 of the head unit 80 as in the fourth embodiment (FIGS. 8 and 9).

(6) As illustrated in the second embodiment (FIG. 5), the guide portion 114 may be configured to protrude in the main scanning direction from the left end surface 78 of the head unit outside the head unit.

Eighth Embodiment

Referring to FIGS. 16 and 17, a head unit 124 according to an eighth embodiment is illustrated. The eighth embodiment differs from the seventh embodiment in that the direction of extension of the ink tubes 26 is defined by defining means 126 instead of the guide portion 114.

The defining means 126 is disposed in the low position portion 64 of the head unit 124. The defining means 126 is a plate-shaped member that protrudes from the low position portion 64 to the second space 70, that is, upward and extends in the horizontal direction, that is, the front-back direction (right-and-left direction on the page surface in FIG. 16). On an upper surface 128 of the defining means 126, the ink tubes 26 are adhered with the adhesive to be aligned in the horizontal direction. The ink tubes 26, which are connected to the extending portions 72, are aligned in the horizontal direction by the defining means 126, and the direction of extension thereof is defined toward the main scanning direction.

<<<Modification Example of Eighth Embodiment>>>

The eighth embodiment described above may be further modified as follows.

(1) The ink tubes 26 may be attached to the upper surface 128 by using the adhesion member such as the double-sided tape instead of mounting the ink tubes 26 on the upper surface 128 of the defining means 126 by using the adhesive.

(2) The defining means 126 may be fixed to the low position portion 64 of the head unit by using the adhesive, may be attached and fixed thereto by using the adhesive material, may be screw-fixed thereto, and various fixing methods can be employed.

(3) In the present embodiment, the ink tubes 26 are fixed to the low position portion 64 of the head unit 80 via the defining means 126, but the ink tubes 26 may be fixed directly to the low position portion 64.

(4) Some of the plurality of ink tubes 26 may be configured to be disposed on the front surface 84 of the head unit 80 as in the fourth embodiment (FIGS. 8 and 9).

(5) As illustrated in the second embodiment (FIG. 5), the defining means 126 may be configured to protrude in the main scanning direction from the left end surface 78 of the head unit outside the head unit.

Ninth Embodiment

Referring to FIG. 18, a printer 132 according to a ninth embodiment is illustrated. A discharge port 138, which discharges the recording medium on which the recording is performed, is disposed on a front surface 136 side of a housing 134 of the printer 132. An opening portion 142 is disposed in a cover portion 140 of the housing 134. The opening portion 142 and the discharge port 138 communicate with each other through an inner space of the printer 132.

In addition, the printer 132 includes a scanner unit 144 that is mounted in a pivotable manner on the housing 134 to be capable of selecting between a state where the opening portion 142 is open and a state where the opening portion 142 is closed. A convex portion 146 is formed on a forward side on a lower surface of the scanner unit 144. In addition, concave portions 148*a* and 148*b*, which correspond to the convex portion 146, are disposed in the right-and-left direction of the opening portion 142 on a forward side of the cover portion 140 of the housing 134. When the scanner unit 144 is closed with respect to the housing 134, the convex portion 146 and the concave portions 148*a* and 148*b* are fitted into each other.

A plate-shaped fixing unit 150 is disposed in the concave portion 148*a* that is positioned on the right side of the opening portion 142. A plurality of holes are disposed in the fixing unit 150 to be aligned in the horizontal direction to be open toward the main scanning direction.

A head unit 152, which is movable in the main scanning direction, is provided in an inner portion of the housing 134. Ink tubes 156 extend from the head unit 152, are aligned in the up-and-down direction through a guide portion 154, and extend in the main scanning direction. The head unit 152 and the guide portion 154 have the same configuration as the head unit 24 and the guide portion 28 of the first embodiment.

The ink tubes 156 are highly curved in the opening portion 142, and the direction of extension thereof is changed to a right end side of the opening portion 142. Furthermore, the ink tubes 156, which extend to the right end side of the opening portion 142, pass through the respective holes of the fixing unit 150 disposed in the concave portion 148*a* to be aligned in the horizontal direction, that is, the front-back direction of the printer 132.

The ink tubes 156, which extend from the fixing unit 150, extend toward the right side of the housing 134. The ink tubes 156 are respectively connected to external ink accommodating portions 158*a*, 158*b*, 158*c*, and 158*d* arranged at separated positions outside the housing 134.

Since the ink tubes 156 are arranged to pass through the holes of the fixing unit 150, the ink tubes 156 are not crushed and pinched between the convex portion 146 and the concave portion 148*a* when the scanner unit 144 is closed with respect to the housing 134.

Figure 26:
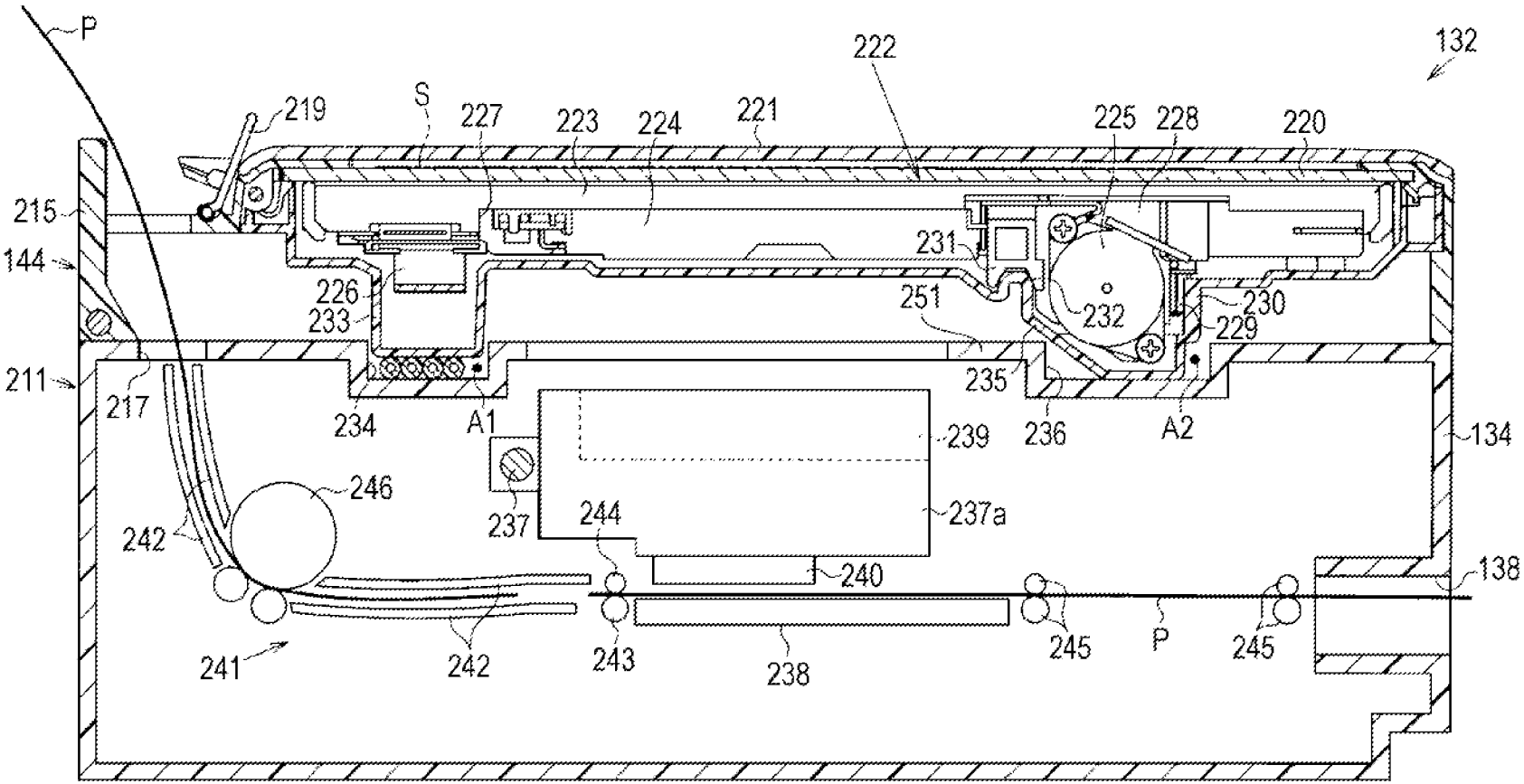
FIG. 26 is a schematic sectional view illustrating an internal configuration of the ink jet printer of the ninth embodiment.

FIG. 26 is a schematic sectional view illustrating an internal configuration of the ink jet printer of the ninth embodiment. The printer 132 includes an ink jet type printer unit 211, and the scanner unit 144 as an opening/closing member disposed on the printer unit 211. The printer 132 has a substantially rectangular parallelepiped overall shape.

The printer unit 211 has the substantially rectangular box-shaped housing 134 that has an upper surface on which the opening portion 142 is formed. In addition, the scanner unit 144 has a bottomed box-shaped scanner frame 215 that constitutes a part of the casing, and a base end of the scanner frame 215 is mounted in a pivotable manner on a back surface side of the housing 134 to open/close the opening portion 142 of the housing 134.

In addition, an inlet 217 is disposed on the back surface side of the housing 134 so as to guide a sheet P in as a target, and the discharge port 138 is disposed on a front surface side of the housing 134 so as to discharge the sheet P out of the housing 134. An inlet cover 219, which opens/closes the inlet 217, is mounted in a pivotable manner on the base end of the scanner frame 215.

A document table 220, which is formed of transparent glass and has a quadrangular plate shape, is arranged on an upper side of the scanner frame 215. In addition, a document cover 221 is mounted in a pivotable manner on the base end of the scanner frame 215 to cover an upper surface of the document table 220 from above. Below the document table 220 in the scanner frame 215, a scanner unit 222 is accommodated so as to read an image such as a character and a figure recorded on a document S mounted on the upper surface of the document table 220.

The scanner unit 222 has a read sensor 223 as a sensor that reads the image, a reading carriage 224 as a carriage that supports the read sensor 223 and moves the read sensor 223 in the main scanning direction, and a motor 225 that is mounted on the reading carriage 224 so as to move the reading carriage 224.

A flexible cable 226 (flat flexible cable), which is disposed to extend from the back surface side of the housing 134, is connected to the reading carriage 224. The flexible cable 226, which is a flat plate-shaped bundle of a plurality of electric wires or the like, allows a control signal to be sent from a control unit (not illustrated) disposed in the housing 134 to the motor 225 and the read sensor 223, and allows the data read by the read sensor 223 to be sent to the control unit. The flexible cable 226 is connected to a connection portion 227 that is disposed at a position which is close to an upstream side in the transport direction of the sheet P in the reading carriage 224.

The motor 225 is supported by a supporting unit 228 that is disposed at a position which is close to the downstream side in the transport direction of the sheet P in the reading carriage 224. A worm gear (not illustrated) that is connected to an output shaft of the reading carriage 224 and a pinion 229 that is engaged with the worm gear to rotate in response to the driving of the motor 225 are supported by the supporting unit 228. In addition, a rack portion 230, which is engaged with the pinion 229 to guide the movement of the reading carriage 224, is disposed to extend in the main scanning direction at a position which is close to the downstream side in the transport direction of the sheet P in the scanner frame 215. In addition, a convex-shaped guide rail 232, which is engaged with a slider 231 disposed in the supporting unit 228 of the reading carriage 224 to support the reading carriage 224 from below, is disposed to protrude from a bottom portion of the scanner frame 215. The guide rail 232 is disposed to extend in the main scanning direction and guides the movement of the reading carriage 224 in the main scanning direction.

At a position of the bottom portion of the scanner frame 215 corresponding to the connection portion 227 in the transport direction of the sheet P, a convex portion 233 for the cable as a cable accommodating portion is formed in the main scanning direction X so as to expand downward a space in which the flexible cable 226 is accommodated. A concave portion 234 is formed, so as to avoid interference with the convex portion 233 for the cable, at a position on the upper surface of the housing 134 below the convex portion 233 for the cable.

In addition, at a position of the bottom portion of the scanner frame 215 corresponding to the supporting unit 228 in the transport direction of the sheet P, a convex portion 235 for the motor (refer to FIG. 18) as a motor accommodating portion is formed in the main scanning direction so as to expand downward a space of movement of the motor 225. A concave portion 236 as a facing portion is formed, so as to avoid interference with the convex portion 235 for the motor, at a position on the upper surface of the housing 134 below the convex portion 235 for the motor. A step portion may be formed as the facing portion so as to avoid the interference with the convex portion 235 for the motor.

Accordingly, in a case where the scanner unit 144 is arranged at a closing position where the opening portion 142 of the housing 134 is closed, the convex portion 233 for the cable is arranged at a position facing the concave portion 234 in a state where a gap A1 is interposed and the convex portion 235 for the motor is arranged at a position facing the concave portion 236 in a state where a gap A2 is interposed.

Next, a configuration of the printer unit 211 will be described. A guide rail 237, which extends in the main scanning direction, is disposed across a side wall of the housing 134, and a recording carriage 237*a* is supported by the guide rail 237 in a state where the recording carriage 237*a* is movable in the main scanning direction. The recording carriage 237*a* reciprocates in response to driving of a carriage motor (not illustrated). In addition, a supporting member 238 is disposed below the recording carriage 237*a* in the housing 134. In other words, a space area above the supporting member 238 in the housing 134 is an area of movement in which the recording carriage 237*a* reciprocates, and an upper portion of the area of movement is exposed outside the housing 134 by the opening portion 142 of the housing 134.

The recording carriage 237*a* is configured to have a recording head 240 as a liquid ejecting head that is integrally incorporated into a lower surface of the recording carriage 237*a*, and a plurality of (four in the present embodiment) relay adapters 239 that are removably received in the recording carriage 237*a*. The relay adapters 239 are adapters that relay the external ink accommodating portion 158 (refer to FIG. 18) which is disposed outside the housing 134 with the recording head 240, and can accommodate ink of each color (cyan ink, magenta ink, yellow ink, and black ink in the present embodiment) as the liquid ejected from the recording head 240.

In addition, the printer unit 211 has a transport mechanism 241 that transports the sheet P, which is guided in from the inlet 217, toward the downstream side where printing is performed by the recording head 240 from the upstream side in the transport direction that is the back surface side in the housing 134. The transport mechanism 241 has a transport path forming member 242 that guides the sheet P, feed rollers 243 and 246 that rotate about an axis of rotation (not illustrated) which extends in a width direction of the sheet P, a driven roller 244 that forms a pair with the feed roller 243, and a pair of paper discharge rollers 245 that discharge the sheet P on which the printing is performed by the recording head 240.

The printer unit 211 performs the printing on the sheet P by ejecting ink from a nozzle of the recording head 240 to an upper surface side of the sheet P that is transported by the transport mechanism 241 and supported by the supporting member 238, and discharges the sheet P, on which the printing is performed, outside the housing 134 from the discharge port 138 by using the pair of paper discharge rollers 245.

The housing 134 has the concave portion 236 (refer to FIG. 18) that faces the convex portion 235 for the motor when the scanner unit 144 is in a closed state, and a cover portion 251 that extends to the concave portion 236 and covers a part of the head unit 152 (refer to FIG. 18) which is positioned in the end portion of the main scanning direction. When the head unit 152 is positioned in the end portion in the main scanning direction, a part of the ink tubes 156 are positioned in a space that is formed by the cover portion 251, the concave portion 236, and the head unit 152.

In addition, when the head unit 152 is positioned in the end portion in the main scanning direction, a part of the ink tubes 156 may extend toward the external ink accommodating portion 158 from a gap between the cover portion 251 or the concave portion 236 and a low position (refer to the low position portion 64 in FIG. 3) at an edge of the adapter accommodating portion.

Tenth Embodiment

Referring to FIG. 19, a printer 160 of a tenth embodiment is illustrated. The tenth embodiment differs from the ninth embodiment in that the external ink accommodating portions 158*c* and 158*d* are arranged to the left side from the housing 134, some of the plurality of ink tubes 156 extend to the right side of the housing 134, and the other ink tubes 156 extend to the left side of the housing 134.

A fixing unit 162*a* is disposed in the concave portion 148*a* that is positioned on the right side of the opening portion 142, and a fixing unit 162*b* is disposed in the concave portion 148*b* that is positioned on the left side of the opening portion 142. The fixing units 162*a* and 162*b* have the same configuration as that of the fixing unit 150 of the ninth embodiment.

Ink tubes 164*a*, 164*b*, 164*c*, and 164*d* extend from the head unit 152, are aligned in the up-and-down direction through the guide portion 154, and extend in the main scanning direction. The ink tubes 164*a* and 164*b* are highly curved in the opening portion 142, and the direction of extension thereof is changed to the right end side of the opening portion 142. Furthermore, the ink tubes 164*a* and 164*b*, which extend to the right end side of the opening portion 142, pass through respective holes of the fixing unit 162*a* disposed in the concave portion 148*a* to be aligned in the horizontal direction. The ink tubes 164*c* and 164*d* extend to the left end side of the opening portion 142 and pass through respective holes of the fixing unit 162*b* disposed in the concave portion 148*b* to be aligned in the horizontal direction.

The ink tubes 164*a* and 164*b*, which extend from the fixing unit 162*a*, extend to the right side from the housing 134. The ink tubes 164*a* and 164*b* are respectively connected to the external ink accommodating portions 158*a* and 158*b* that are arranged at the separated positions on the right side from the housing 134. The ink tubes 164*c* and 164*d*, which extend from the fixing unit 162*b*, extend to the left side from the housing 134. The ink tubes 164*c* and 164*d* are respectively connected to the external ink accommodating portions 158*c* and 158*d* that are arranged at the separated positions on the left side from the housing 134.

<<<Modification Example of Ninth and Tenth Embodiments>>>

The ninth and tenth embodiments described above may be further modified as follows.

(1) In the eighth embodiment illustrated in FIG. 18, the ink tubes 156 may be configured to extend to the left side from the housing 134. In addition, in conjunction with this configuration, the fixing unit 150 may be configured to be disposed in the concave portion 148*b* that is positioned on the left side of the opening portion 142.

(2) The ink tubes 156 pass through the holes of the fixing units 150, 162*a*, and 162*b*. However, semicircular notches may take the place of the holes so that the ink tubes 156 are mounted on the notches by using the adhesive or the like.

(3) The ink tubes 156 may be fixed to the holes of the fixing units 150, 162*a*, and 162*b* by using the adhesive or the like, and may simply pass through the holes without being fixed.

(4) In the printers 132 and 160 of the ninth embodiment and the tenth embodiment, the ink tubes 156 and 164 may be configured to be extended by the guide portion or the defining means described in the second embodiment to the eighth embodiment, instead of the head unit 152 and the guide portion 154, as another embodiment.

Eleventh Embodiment

Referring to FIG. 20, a front view of the arrangement area of the ink tubes 26 according to the eleventh embodiment is illustrated. In FIG. 20, the configuration of the first embodiment is used to describe the arrangement area of the ink tubes 26.

FIG. 20 illustrates the head unit 24 positioned on the left end side in the main scanning direction with the cover portion 20 of the housing 18 covering the head unit 24 from above. The second space 70 is generated between the cover portion 20 and the low position portion 64 of the head unit 24 in the up-and-down direction.

The ink tubes 26, which extend from the extending portions 72 of the relay adapters 60, pass through the guide portion 28 that is disposed in the low position portion 64. The ink tubes 26, which extend from the guide portion 28, are curved to the left from the head unit 24, are folded back to the right from the head unit 24, and extend to the opening portion 22 (not illustrated) above and across the guide portion 28 and the extending portions 72. Accordingly, in the present embodiment, the ink tubes 26 are arranged by using the up-and-down direction of the second space 70.

The arrangement of the ink tubes of the present embodiment can be applied to not only the first embodiment but also the second embodiment to the tenth embodiment.

Twelfth Embodiment

Referring to FIG. 21, a top view of the arrangement area of the ink tubes 26 according to the twelfth embodiment is illustrated. In FIG. 21, the configuration of the first embodiment is used to describe the arrangement area of the ink tubes 26.

FIG. 21 illustrates the head unit 24 positioned on the left end side in the main scanning direction with the front of the head unit 24 covered by the front surface 30 of the housing 18. A space 168 is generated between the front surface 30 of the housing 18 and the front surface 84 of the head unit 24 in the horizontal direction.

The ink tubes 26, which extend from the extending portions 72 of the relay adapters 60, pass through the guide portion 28 that is disposed in the low position portion 64. The ink tubes 26, which extend from the guide portion 28, are curved to the left from the head unit 24, are folded back to the right from the head unit 24, and extend to the opening portion 22 (not illustrated) above the front of the head unit 24. Accordingly, in the present embodiment, the ink tubes 26 are arranged by using the space 168 between the front surface 30 of the housing 18 and the front surface 84 of the head unit 24.

The arrangement of the ink tubes of the present embodiment can be applied to not only the first embodiment but also the second embodiment to the tenth embodiment.

Other Embodiments

Figure 22:
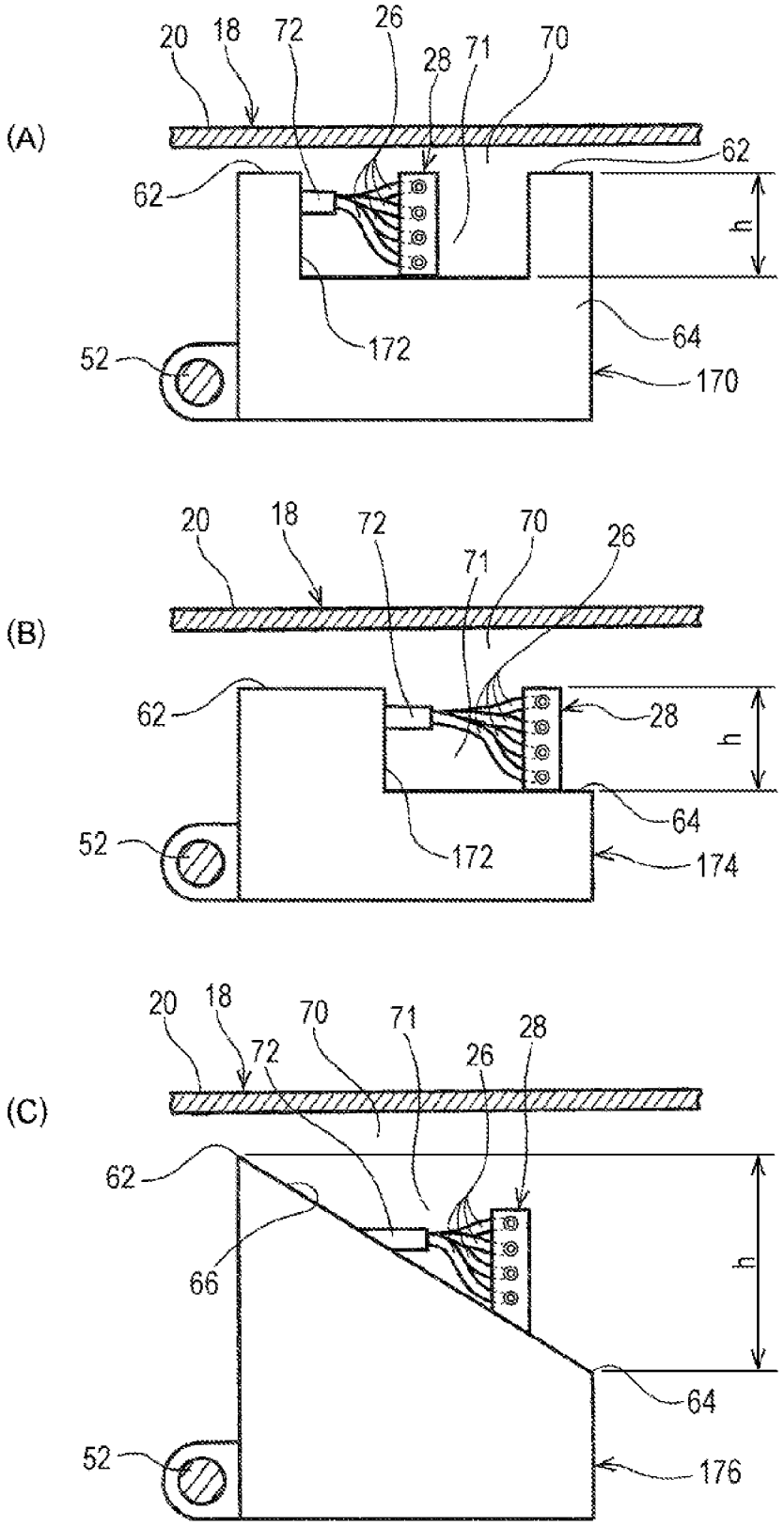
FIGS. 22A, 22B, and 22C are side views of head units of other embodiments.
Figure 23:
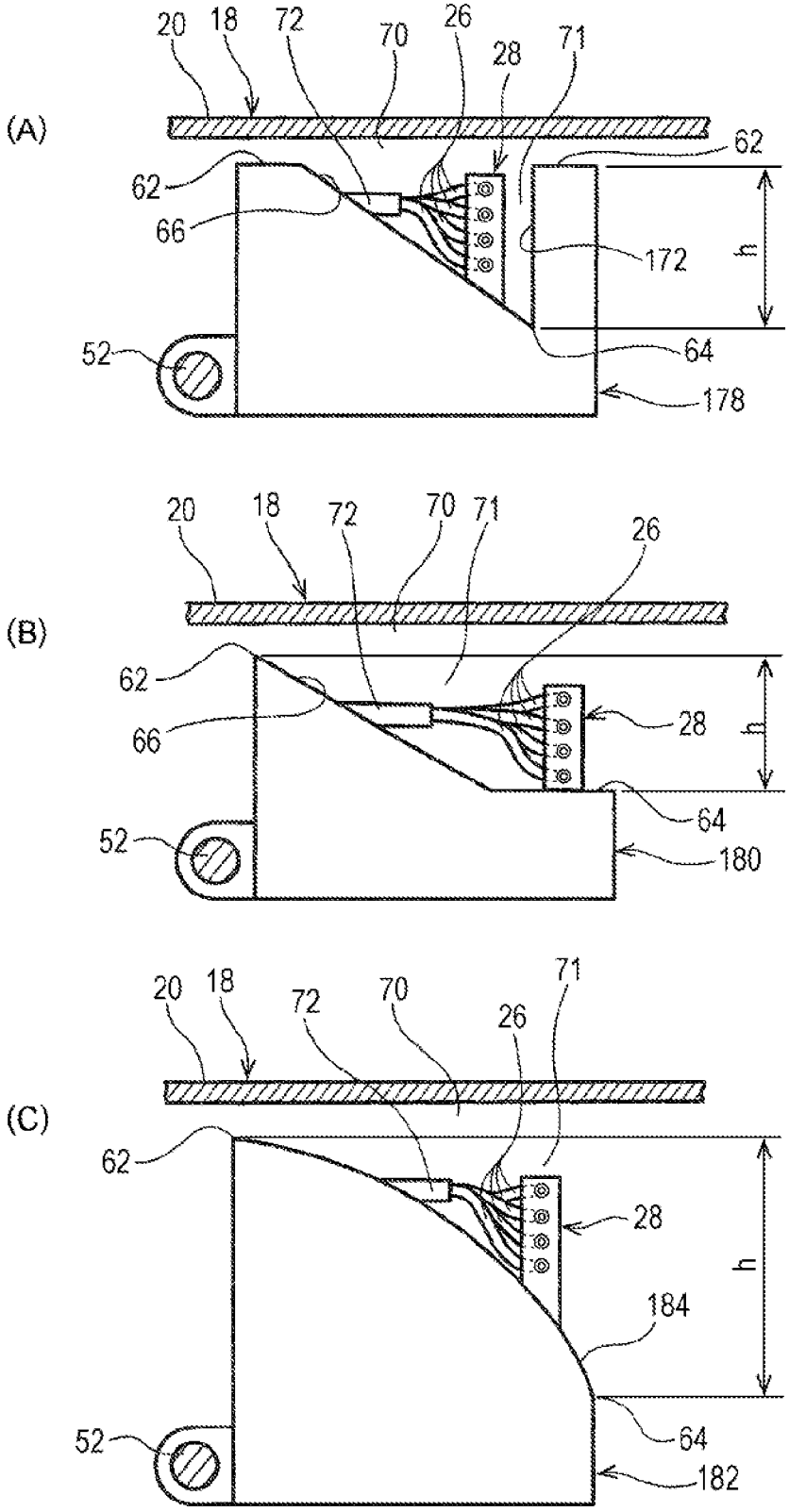
FIGS. 23A, 23B, and 23C are side views of head units of other embodiments.

The head unit can have various side-view shapes (in particular, shapes relating to the height difference in the upper portion). FIGS. 22 to 24 illustrate these shapes. Referring to FIG. 22A, FIG. 22B, FIG. 22C, FIG. 23A, FIG. 23B, FIG. 23C, FIG. 24A, FIG. 24B, and FIG. 24C, side views of a thirteenth embodiment to a twenty first embodiment of head units according to the present invention are illustrated.

A head unit 170 of the thirteenth embodiment that is illustrated in FIG. 22A has the high position portions 62 disposed at two places and the low position portion 64 which is configured to be disposed between the two high position portions 62. In the present embodiment, a vertical surface 172 is configured to take the place of the inclined surface 66 between the high position portions 62 and the low position portion 64. The extending portions 72 are disposed on the vertical surface 172, and the guide portion 28 is disposed in the low position portion 64.

A head unit 174 of the fourteenth embodiment that is illustrated in FIG. 22B is configured to have the vertical surface 172 instead of the inclined surface 66 between the high position portion 62 and low position portion 64. The extending portions 72 are disposed on the vertical surface 172, and the guide portion 28 is disposed in the low position portion 64.

A head unit 176 of the fifteenth embodiment that is illustrated in FIG. 22C is configured such that the inclined surface 66 is across from the high position portion 62 to the low position portion 64 without a flat portion being disposed between the high position portion 62 and the low position portion 64. In this configuration, the extending portions 72 and the guide portion 28 are disposed on the inclined surface 66.

A head unit 178 of the sixteenth embodiment that is illustrated in FIG. 23A has the high position portions 62 disposed at two places and the low position portion 64 disposed between the two high position portions 62. The inclined surface 66 is disposed between one of the high position portions 62 and the low position portion 64, and the vertical surface 172 is disposed between the other high position portion 62 and the low position portion 64. In this configuration, the extending portions 72 and the guide portion 28 are disposed on the inclined surface 66.

A head unit 180 of the seventeenth embodiment that is illustrated in FIG. 23B has the inclined surface 66 disposed between the high position portion 62 and the low position portion 64. No flat portion is disposed in the high position portion 62. In this configuration, the extending portions 72 are disposed on the inclined surface 66, and the guide portion 28 is disposed in the low position portion 64.

In a head unit 182 of the eighteenth embodiment that is illustrated in FIG. 23C, no flat portion is disposed in the high position portion 62 and the low position portion 64, and a convex curved surface 184 is configured to be disposed across from the high position portion 62 to the low position portion 64. In this configuration, the extending portions 72 and the guide portion 28 are disposed on the convex curved surface 184.

A head unit 186 of the nineteenth embodiment that is illustrated in FIG. 24A has a concave curved surface 188 disposed between the high position portion 62 and the low position portion 64. No flat portion is disposed in the high position portion 62. In this configuration, the extending portions 72 are disposed on the concave curved surface 188, and the guide portion 28 is disposed in the low position portion 64.

A head unit 190 of the twentieth embodiment that is illustrated in FIG. 24B has a convex curved surface 184 disposed between the high position portion 62 and the low position portion 64. In this configuration, the extending portions 72 are disposed on the convex curved surface 184, and the guide portion 28 is disposed in the low position portion 64.

A head unit 192 of the twenty first embodiment that is illustrated in FIG. 24C has the concave curved surface 188 disposed between the high position portion 62 and the low position portion 64. No flat portion is disposed in the low position portion 64. In this configuration, the extending portions 72 and the guide portion 28 are disposed on the concave curved surface 188.

The guide portion 28 of the first embodiment is configured to regulate the direction of extension of the ink tubes for the description of the thirteenth embodiment to the twenty first embodiment described above. However, without being limited thereto, the guide portion or the defining means described in the second embodiment to the eighth embodiment can be configured to regulate the direction of extension.

The present invention is not limited to the embodiments described above, and various modifications are possible within the scope of the present invention. It is to be appreciated that such modifications are included within the scope of the present invention.

REFERENCE SIGNS LIST

10 Printer
16 Discharge port
18 Housing
20 Cover portion
22 Opening portion
24 Head unit
26 Ink tube

32 Front surface fixing unit
36, 36*a* to 36*d* External ink accommodating portion
50 Recording head
58 Adapter accommodating portion
60 Relay adapter
62 High position portion
64 Low position portion
66 Inclined surface
68 First space
70 Second space
71 Third space
72 Extending portion
76, 80, 90, 100, 108 Head unit
110 Printer
112, 124 Head unit
132, 160 Printer
134 Housing
138 Discharge port
140 Cover portion
142 Opening portion
144 Scanner unit
148*a* Concave portion
148*b* Concave portion
152 Head unit
156 Ink tube
158, 158*a* to 158*d* External ink accommodating portion
160 Printer
164*a* to 164*d* Ink tube
168 Space
170, 174, 176, 178, 180, 182, 186, 190, 192 Head unit
211 Printer unit
215 Scanner frame
223 Read sensor
224 Reading carriage
225 Motor
235 Convex portion for motor
236 Concave portion
237*a* Recording carriage
239 Relay adapter
240 Recording head
251 Cover portion
h Height difference

The invention claimed is:

1. An ink jet recording device comprising:

a head unit that includes a recording head which ejects ink and a relay member which relays an ink accommodating portion where ink is accommodated with the recording head, and is movable in a scanning direction of the recording head; and an ink tube that is connected to the relay member, guides ink which is sent from the ink accommodating portion to the relay member, and has flexibility, wherein the ink jet recording device further includes a cover portion that covers at least a part of the head unit that is opposite an nozzle surface where the ink in ejected when the head unit is positioned in an end portion in the scanning direction, wherein a high position with a narrow gap from the cover portion and a low position with a wide gap from the cover portion are formed in an upper portion of a relay member accommodating portion of the head unit where the relay member is accommodated, and wherein a part of the ink tube extends outside the head unit by using the gap that is formed between the low position of the relay member accommodating portion and the cover portion when the head unit is positioned in the end portion in the scanning direction.

2. The ink jet recording device according to claim 1, further comprising a plurality of the ink tubes, wherein the plurality of ink tubes are arranged in an up-and-down direction to extend from the head unit.

3. The ink jet recording device according to claim 1, further comprising a plurality of the ink tubes, wherein the plurality of ink tubes are arranged in a horizontal direction to extend from the head unit.

4. The ink jet recording device according to claim 1, further comprising a plurality of the ink tubes, wherein the plurality of ink tubes are arranged in a transverse direction on an upper surface of the cover portion to be fixed to the upper surface of the cover portion.

5. The ink jet recording device according to claim 1, wherein the cover portion has an opening portion that exposes an upper portion of at least a part of an area of movement of the head unit, and a concave portion, which extends laterally from the opening portion, on an upper surface when a side where a discharge port, where a recording target medium on which recording is performed is discharged, is disposed is a forward side of the device, and wherein the ink tube extends laterally from the cover portion through the concave portion.

6. The ink jet recording device according to claim 5, further comprising a plurality of the ink tubes, wherein the plurality of ink tubes are arranged in a horizontal direction in the concave portion.

7. The ink jet recording device according to claim 5, wherein a plurality of the ink tubes that are arranged in a horizontal direction in the concave portion are fixed into the concave portion.

8. The ink jet recording device according to claim 1, further comprising a plurality of the ink tubes, wherein an array direction of the plurality of ink tubes is converted from a horizontal direction to an up-and-down direction or from the up-and-down direction to the horizontal direction by an array conversion unit that converts the array direction of the plurality of ink tubes.

9. The ink jet recording device according to claim 1, wherein the ink accommodating portion is provided outside the cover portion.

10. An ink jet recording device comprising:

a printer unit; and a scanner unit that is mounted in an openable/closable manner on the printer unit, wherein the printer unit includes a housing, an ink accommodating portion where ink is accommodated, and a head unit that is arranged in the housing and moves in a main scanning direction, wherein the head unit has a recording head that ejects ink, a relay member that supplies ink to the recording head, and a relay member accommodating portion that accommodates the relay member, wherein the printer unit further includes an ink tube that supplies ink in the ink accommodating portion to the relay member, and a discharge port that discharges a recording medium on which recording is performed by the recording head, wherein the scanner unit includes a scanner frame, a carriage that is arranged in the scanner frame, has a sensor, and moves in the main scanning direction, and a convex portion that is disposed in the scanner frame and is positioned on the further discharge port side than the head unit, wherein the housing has a facing portion that faces the convex portion for the motor when the scanner unit is in a closed state, and a cover portion that extends to the facing portion and covers at least a part of the head unit which is positioned in an end portion in the main scanning direction, and wherein a part of the ink tube is positioned in a space that is formed by the cover portion, the facing portion, and the head unit when the head unit is positioned in the end portion in the main scanning direction.

11. The ink jet recording device according to claim 10, further comprising a plurality of the ink tubes, wherein an array direction of the plurality of ink tubes is converted from a horizontal direction to an up-and-down direction or from the up-and-down direction to the horizontal direction by an array conversion unit that converts the array direction of the plurality of ink tubes.

12. The ink jet recording device according to claim 11, wherein the array conversion unit is disposed in the device.

13. The ink jet recording device according to claim 10, wherein the ink accommodating portion is provided outside the housing.

14. A ink jet recording device comprising:

a printer unit; and a scanner unit that is mounted in an openable/closable manner on the printer unit, wherein the printer unit includes a housing, an ink accommodating portion where ink is accommodated, and a head unit that is arranged in the housing and moves in a main scanning direction, wherein the head unit has a recording head that ejects ink, a relay member that supplies ink to the recording head, and a relay member accommodating portion that accommodates the relay member, wherein the printer unit further includes an ink tube that supplies ink in the ink accommodating portion to the relay adapter, and a discharge port that discharges a recording medium on which recording is performed by the recording head, wherein the relay member accommodating portion has an edge that forms an accommodating port which accommodates the relay member, wherein a discharge port side of the edge is formed to be lower than the side of the edge opposite to the discharge port side, wherein the scanner unit includes a scanner frame, a carriage that is arranged in the scanner frame, has a sensor, and moves in the main scanning direction, and a convex portion that is disposed in the scanner frame and is positioned on the further discharge port side than the head unit, wherein the housing has a facing portion that faces the convex portion when the scanner unit is in a closed state, and a cover portion that extends to the facing portion and covers a part of the head unit which is positioned in an end portion in the main scanning direction, and wherein a part of the ink tube extends toward the ink accommodating portion from a gap between the cover portion or the facing portion and the low position at the edge of the relay member accommodating portion when the head unit is positioned in the end portion in the main scanning direction.

15. The ink jet recording device according to claim 14, further comprising a plurality of the ink tubes, wherein an array direction of the plurality of ink tubes is converted from a horizontal direction to an up-and-down direction or from the up-and-down direction to the horizontal direction by an array conversion unit that converts the array direction of the plurality of ink tubes.

16. The ink jet recording device according to claim 15, wherein the array conversion unit is disposed in the a device.

17. The ink jet recording device according to claim 14, wherein the ink accommodating portion is provided outside the housing.

* * * * *